US010465455B2

(12) United States Patent
Berry et al.

(10) Patent No.: US 10,465,455 B2
(45) Date of Patent: Nov. 5, 2019

(54) AUTOMATED TUBULAR RACKING SYSTEM

(71) Applicant: Schlumberger Technology Corporation, Sugar Land, TX (US)

(72) Inventors: Joe Rodney Berry, Cypress, TX (US); Robert Metz, Cypress, TX (US); Melvin Alan Orr, Tulsa, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/311,860

(22) PCT Filed: Nov. 15, 2016

(86) PCT No.: PCT/US2016/061952
§ 371 (c)(1),
(2) Date: Nov. 17, 2016

(87) PCT Pub. No.: WO2017/087349
PCT Pub. Date: May 26, 2017

(65) Prior Publication Data

US 2018/0087332 A1 Mar. 29, 2018

Related U.S. Application Data

(60) Provisional application No. 62/330,200, filed on May 1, 2016, provisional application No. 62/330,021, filed
(Continued)

(51) Int. Cl.
*E21B 19/14* (2006.01)

(52) U.S. Cl.
CPC ..... *E21B 19/14* (2013.01)

(58) Field of Classification Search
CPC ..... E21B 19/14; E21B 19/15; E21B 19/155; E21B 19/20; E21B 19/16
(Continued)

(56) References Cited

U.S. PATENT DOCUMENTS 2,412,020 A * 12/1946 Walters ..... E21B 19/14 182/114
3,253,995 A 5/1966 Antonsen et al.
(Continued)

FOREIGN PATENT DOCUMENTS

EP 0979924 A2 2/2000
RU 2100565 C1 12/1997
(Continued)

*Primary Examiner* — Lynn E Schwenning
(74) *Attorney, Agent, or Firm* — Rachel E. Greene

(57) ABSTRACT

A tubular racking system has a racking module connected to a drilling rig mast. The racking module has a frame, a fingerboard assembly, and a clasp extendable to a stand hand-off position for securing a tubular stand in position. An upper racking mechanism (upper racking mechanism) has a bridge translatably connected to the frame. An arm is rotatably and translatably connected to the bridge. A gripper is translatably connected to the arm. A setback platform module has a platform and an alleyway adjacent the platform. A lower racking mechanism (lower racking mechanism) is translatably connected to the alleyway. The lower racking mechanism is rotatably and extendable with a clasp operable to secure a tubular stand from horizontal movement. Movements of the lower racking mechanism are controlled by movements of the upper racking mechanism.

7 Claims, 29 Drawing Sheets

Related U.S. Application Data on Apr. 29, 2016, provisional application No. 62/256,013, filed on Nov. 16, 2015.

(58) Field of Classification Search
USPC ..... 414/22.51–22.71
See application file for complete search history.

(56) References Cited

U.S. PATENT DOCUMENTS 3,874,518 A 4/1975 Swoboda, Jr. et al.
4,042,123 A * 8/1977 Sheldon ..... E21B 19/14 175/85
4,274,778 A 6/1981 Putnam et al.
4,348,920 A 9/1982 Boyadjieff
4,421,179 A 12/1983 Boyadjieff
4,462,733 A * 7/1984 Langowski ..... E21B 19/14 254/415
4,501,522 A 2/1985 Causer et al.
4,610,315 A * 9/1986 Koga ..... E21B 19/20 175/203
4,621,974 A 11/1986 Krueger
4,715,761 A 12/1987 Berry et al.
4,738,321 A 4/1988 Olivier
4,850,439 A 7/1989 Lund
5,038,871 A 8/1991 Dinsdale
5,107,940 A 4/1992 Berry
5,211,251 A 5/1993 Woolslayer
5,423,390 A 6/1995 Donnally et al.
6,220,807 B1 4/2001 Sorokan
6,513,605 B1 2/2003 Lodden
6,557,651 B1 5/2003 Norby et al.
6,591,471 B1 7/2003 Hollingsworth et al.
6,591,904 B2 7/2003 Cicognani
6,609,565 B1 8/2003 Andreychuk et al.
6,748,823 B2 6/2004 Pietras
6,779,614 B2 8/2004 Oser
6,821,071 B2 11/2004 Woolslayer et al.
6,860,337 B1 3/2005 Orr et al.
6,976,540 B2 12/2005 Berry
6,997,265 B2 2/2006 Berry
7,043,814 B2 5/2006 Hollingsworth et al.
7,114,235 B2 10/2006 Jansch et al.
7,140,445 B2 11/2006 Shahin et al.
7,219,744 B2 5/2007 Pietras
7,246,983 B2 7/2007 Zahn et al.
7,331,746 B2 2/2008 Wright et al.
7,353,880 B2 4/2008 Pietras
7,451,826 B2 11/2008 Pietras
7,677,856 B2 3/2010 Standal
7,681,632 B2 3/2010 Wood
7,699,122 B2 * 4/2010 Eriksen ..... E21B 19/14 175/52
7,794,192 B2 9/2010 Wright et al.
7,802,636 B2 9/2010 Childers et al.
7,828,085 B2 11/2010 Kuttel et al.
7,931,077 B2 4/2011 Rudshaug et al.
8,028,748 B2 10/2011 Laitolais, Jr. et al.
8,052,370 B2 11/2011 Dekker et al.
8,186,455 B2 5/2012 Childers et al.
8,186,925 B2 5/2012 Littlely
8,186,926 B2 5/2012 Littlely
8,215,887 B2 7/2012 Fikowski et al.
8,317,448 B2 11/2012 Hankins et al.
8,397,837 B2 3/2013 Skogerbo
8,550,761 B2 10/2013 Belik et al.
8,584,773 B2 11/2013 Childers et al.
8,839,881 B1 9/2014 Baumler
8,839,884 B2 9/2014 Kuttel et al.
8,910,719 B2 12/2014 Kockeis et al.
8,949,416 B1 2/2015 Barnes et al.
8,961,093 B2 2/2015 Springett et al.
8,992,152 B2 3/2015 Nouwens et al.
9,010,410 B2 4/2015 Story
2004/0069532 A1 4/2004 Keast
2005/0173154 A1 8/2005 Lesko
2007/0193750 A1 * 8/2007 Wright ..... E21B 19/20 166/379
2008/0164064 A1 7/2008 Belik et al.
2008/0302525 A1 12/2008 Beierbach et al.
2009/0053015 A1 * 2/2009 Zachariasen ..... E21B 19/14 414/22.66
2009/0274545 A1 11/2009 Liess et al.
2010/0243325 A1 9/2010 Veeningen
2010/0303586 A1 * 12/2010 Hankins ..... E21B 19/14 414/22.51
2010/0326672 A1 12/2010 Childers et al.
2011/0079434 A1 4/2011 Belik et al.
2011/0174483 A1 7/2011 Odell et al.
2012/0020758 A1 1/2012 Springett et al.
2012/0067642 A1 3/2012 Magnuson
2012/0305261 A1 12/2012 Roodenburg et al.
2013/0025937 A1 1/2013 Pilgrim et al.
2013/0112395 A1 5/2013 Story
2013/0220601 A1 8/2013 Ferrari
2013/0284450 A1 10/2013 Roodenburg et al.
2014/0110174 A1 4/2014 Childers et al.
2014/0124218 A1 5/2014 Pilgrim
2014/0202769 A1 7/2014 Magnuson
2014/0328650 A1 11/2014 Hu et al.
2016/0060979 A1 * 3/2016 Magnuson ..... E21B 19/14 414/22.63
2017/0234088 A1 8/2017 Orr et al.
2018/0216405 A1 * 8/2018 De Mul ..... E21B 3/02
2018/0328112 A1 11/2018 Berry et al.
2019/0017334 A1 1/2019 Loeyning et al.
2019/0106950 A1 4/2019 Alvaer et al.

FOREIGN PATENT DOCUMENTS

RU 2541972 C2 2/2015
WO 9315303 A1 8/1993
WO 0111181 A1 2/2001
WO 0218742 A1 3/2002
WO 2006059910 A1 6/2006
WO 2010141231 A2 12/2010
WO 2011016719 A1 2/2011
WO 2011056711 A2 5/2011
WO 2012148286 A1 11/2012
WO 2014029812 A2 2/2014
WO WO 2016/204608 * 12/2016 ..... E21B 19/06
WO 2017087200 A1 5/2017
WO 2017087349 A1 5/2017
WO 2017087350 A1 5/2017

* cited by examiner

AUTOMATED TUBULAR RACKING SYSTEM

CROSS REFERENCE TO RELATED APPLICATIONS

This application is a National Stage application of International Application No. PCT/US2016/061952 filed Nov. 15, 2016, which claims priority to U.S. Provisional Application Ser. No. 62/330,200, filed May 1, 2016, U.S. Provisional Application Ser. No. 62/256,013, filed Nov. 16, 2015, and U.S. Provisional Application Ser. No. 62/330,021, filed Apr. 29, 2016. These four patent applications are incorporated herein by reference in their entirety.

BACKGROUND

In the exploration of oil, gas and geothermal energy, drilling operations are used to create boreholes, or wells, in the earth. Modern drilling rigs may have two, three, or even four mast sections for sequential connection and raising above a substructure. The drilling rigs are transported to the locations where drilling activity is to be commenced. Once transported, large rig components are moved from a transport trailer into engagement with the other components located on the drilling pad.

Moving a full-size drilling rig requires significant disassembly and reassembly of the substructure, mast, and related component. Speed of disassembly and reassembly impacts profitability but safety is the primary concern. A reduction in disassembly reduces errors and delay in reassembly.

Transportation constraints and cost limit many of the design opportunities for building drilling rigs that can drill a well faster. Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target.

A set of drill collars are located above the bottom-hole assembly to provide a non-collapsible source of weight to help the drill bit crush the formation. Heavy weight drill pipe is located above the drill collars for safety. The remainder of the drill string is mostly drill pipe, designed to be under tension. Each drill pipe is roughly 30 feet long, but lengths vary based on the style. It is common to store lengths of drill pipe in "doubles" (two connected lengths) or "triples" (three connected lengths) or even "fourables" (four connected lengths).

When the drill bit wears out, or when service, repairs or adjustments need to be made to the bottom-hole assembly, the drill string (drill pipe and other components) is removed from the wellbore and setback. When removing the entire drill string from the well, it is typically disconnected and setback in doubles or triples until the drill bit is retrieved and exchanged. This process of pulling everything out of the hole and running it all back in the hole is known as "tripping."

Tripping is non-drilling time and, therefore, an expense. Efforts have long been made to devise ways to avoid it or at least speed it up. Running triples is faster than running doubles because it reduces the number of threaded connections to be disconnected and then reconnected. Triples are longer and therefore more difficult to handle due to their length and weight and the natural waveforms that occur when moving them around. Manually handling moving pipe in the derrick and at the drill floor level can be dangerous.

It is desirable to have a drilling rig with the capability to increase safety and reduce trip time. It is desirable to have a drilling rig with the capability of handing stands of drilling tubulars to devices alternative to conventional elevators and top drives. It is also desirable to have a system that includes redundancy, such that if an element of the system fails or requires servicing, the task performed by that unit can be taken-up by another unit on the drilling rig.

Most attempts to automate pipe racking are found offshore. However, solutions for pipe delivery on offshore drilling rigs are seldom transferable to onshore land rigs, due to the many differences in economic viability, size, weight, and transportation considerations.

Thus, a need remains for a reliable automated racking system module that provides redundancy, is safe and reliable, affordable, and practical given the constraints of weight and size for support when cantilevered on the mast of a transportable land drilling rig.

SUMMARY

A tubular racking system for a drilling rig is disclosed. In one embodiment, the tubular racking system has a racking module connected to a drilling rig mast. The racking module comprises a frame, a fingerboard assembly connected to the frame, and an upper stand constraint having a clasp connected to the fingerboard assembly. The clasp is extendable to a stand hand-off position for securing a tubular stand in position.

An upper racking mechanism is provided having a bridge translatably connected to the frame. An arm is rotatably and translatably connected to the bridge. A gripper is translatably connected to the arm. The gripper is operable to grip and hoist an upper end of a tubular stand.

A setback platform module is provided, and comprises a platform positioned beneath the fingerboard assembly. An alleyway is connected adjacent to a side of the platform. A lower racking mechanism has a base translatably connected to the alleyway. A frame is rotatably connected to the base. An arm is pivotally connected to the frame. A clasp is pivotally connected to the arm. The clasp is operable to secure a tubular stand from horizontal movement. Movements of the lower racking mechanism are controlled by movements of the upper racking mechanism, so as to maintain the tubular stands in a vertical orientation at all times.

In another embodiment, the fingerboard assembly has a fingerboard platform and a plurality of finger extensions on each side of the fingerboard platform. A modular frame is provided that includes an inner runway and an outer runway. An upper racking mechanism is horizontally translatable along the inner and outer runways. The upper racking mechanism has a bridge with roller assemblies connecting it to the runways.

A trolley is located on the bridge in translatable relation. A rotatable actuator is attached to the trolley. An arm assembly extends downwards from the actuator. A tubular gripping mechanism is attached to the end of the arm for gripping racked tubular stands or tubular stands at the stand hand-off position for racking.

In another embodiment, a grip centerline at the center of tubulars held in the gripping mechanism is coincident with an actuator centerline at the center of rotation of the rotary actuator.

In another embodiment, an extendable tubular stand constraint is mounted on the racking module for use as an upper stand constraint. In another embodiment, a top surface of the upper stand constraint forms the platform of the fingerboard assembly. In another embodiment, a sleeve is mounted over the arm in translatable relation. The gripper is attached to the end of the sleeve. A cylinder assembly is connected between the arm and the sleeve. The cylinder assembly has a counterbalance cylinder and a compensating cylinder mounted in tandem with the counterbalance cylinder.

In another embodiment, an extendable tubular stand constraint is mounted on the setback platform for use as a lower stand constraint. The lower stand constraint secures the lower end of the tubular stand in position at the stand hand-off position.

As will be understood by one of ordinary skill in the art, the assembly disclosed may be modified and the same advantageous result obtained. Though descriptions provided herein are as to selecting and transporting tubular stands for tripping into the well, it will be understood that the disclosed embodiments may be fully functional when operated in reverse, and tripping out of the well and racking the tubular stands. Though descriptions provided herein are generally as to stands formed as triples, it will be understood that the disclosed embodiments may be fully functional when operated using stands formed of doubles or fourables.

BRIEF DESCRIPTION OF THE DRAWINGS

The objects and features of the disclosed embodiments will become more readily understood from the following detailed description and appended claims when read in conjunction with the accompanying drawings in which like numerals represent like elements.

The drawings constitute a part of this specification and include embodiments in various forms. It is to be understood that in some instances various aspects of the disclosed embodiments may be shown exaggerated or enlarged to facilitate an understanding of the principles and features of the disclosed embodiments.

DETAILED DESCRIPTION

The following description is presented to enable any person skilled in the art to make and use the automated tubular racking system, and is provided in the context of a particular application and its requirements. Various modifications to the disclosed embodiments will be readily apparent to those skilled in the art, and the general principles defined herein may be applied to other embodiments and applications without departing from their spirit and scope. Thus, the disclosure is not intended to be limited to the embodiments shown, but is to be accorded the widest scope consistent with the embodiments disclosed herein.

Figure 1:
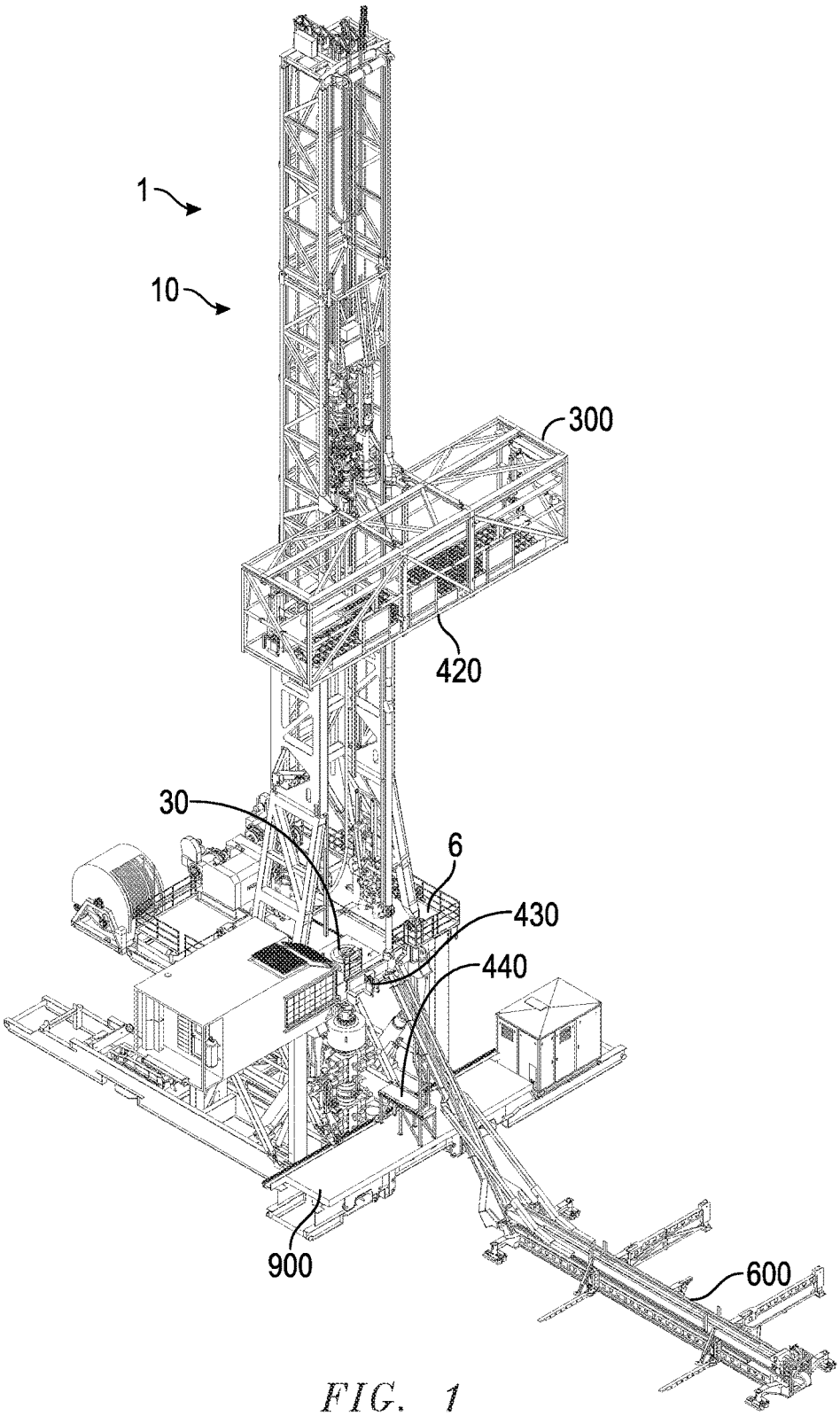
FIG. 1 is an isometric view of a drilling rig having a racking module attached to its mast.

FIG. 1 is an isometric view of a drilling rig 1 having a racking module 300 attached to its mast 10. Racking module 300 is detachable for transport.

Figure 2:
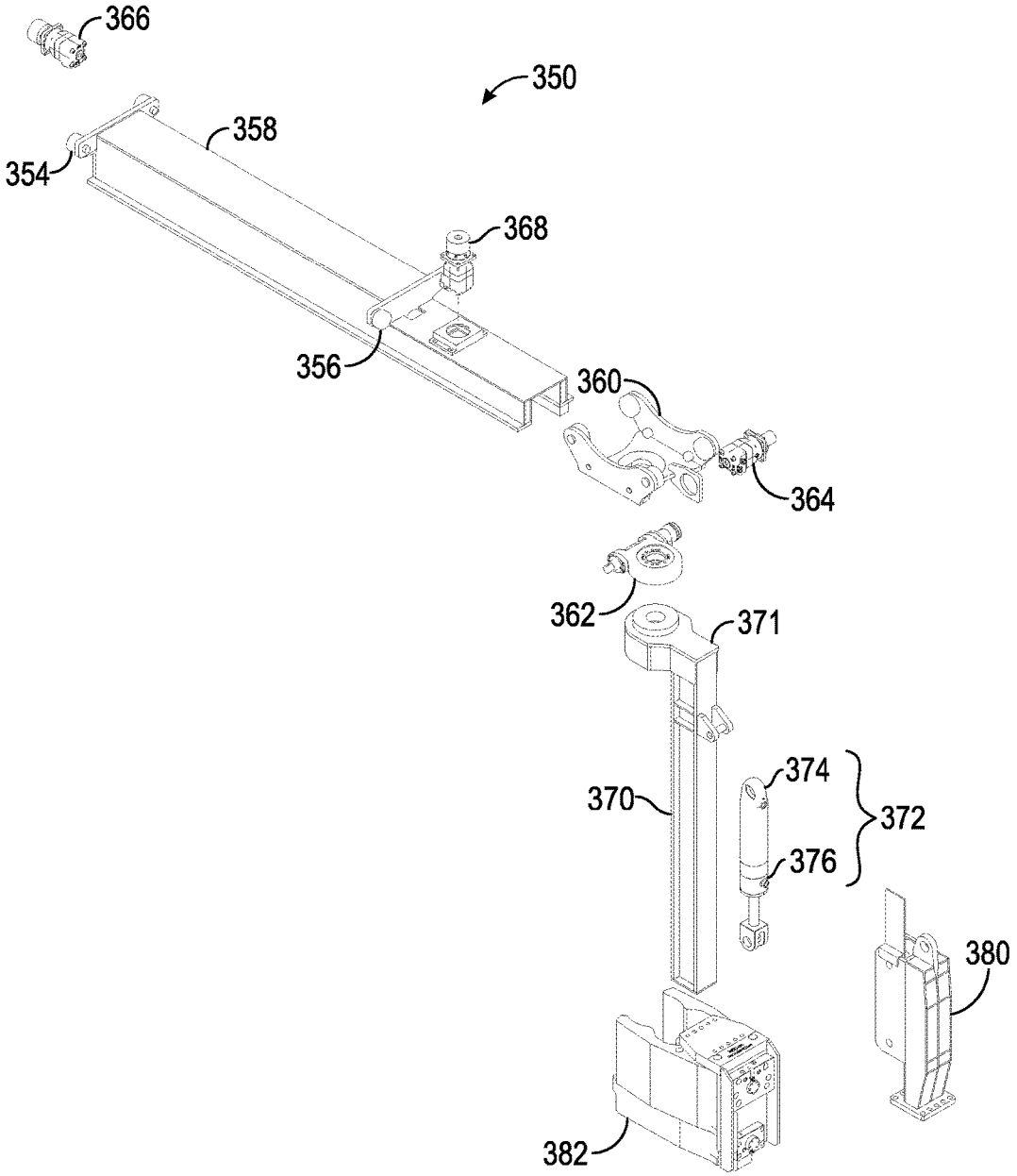
FIG. 2 is an exploded isometric view of an upper racking mechanism component of the racking module of FIG. 1, illustrated in accordance with an embodiment of the racking module.

FIG. 2 is an exploded isometric view of an upper racking mechanism 350 component of racking module 300 of FIG. 1, illustrated in accordance with an embodiment of racking module 300. Upper racking mechanism 350 has a bridge 358 that is mounted in translatable relation to racking module 300. In the embodiment illustrated, bridge 358 has an outer roller assembly 354 and an inner roller assembly 356 for supporting movement of upper racking mechanism 350 along runways 306 and 304, respectively (see FIG. 8), on racking module 300.

An outer pinion drive 366 extends from an outer end of bridge 358. An inner pinion drive 368 extends proximate to the inner end (mast side) of bridge 358. In the embodiment illustrated, outer pinion drive 366 engages a complementary geared rack on runway 306. Inner pinion drive 368 engages a complementary geared rack on runway 304. Actuation of outer pinion drive 366 and inner pinion drive 368 permits upper racking mechanism 350 to horizontally translate the full length of racking module 300.

A trolley 360 is translatably mounted to bridge 358. In the embodiment illustrated, the position of trolley 360 is controlled by a trolley pinion drive 364. Trolley pinion drive 364 engages a complementary geared rack on bridge 358. Actuation of trolley pinion drive 364 permits trolley 360 to horizontally translate the length of bridge 358.

An arm 370 is rotatably connected to trolley 360. In the embodiment illustrated, a rotate actuator 362 is mounted to trolley 360. Arm 370 is connected at an offset 371 to rotate actuator 362 and thus trolley 360. A gripper 382 extends perpendicular in relation to the lower end of arm 370, and in the same plane as offset 371.

Gripper 382 is connected to arm 370 in vertically translatable relation. In the embodiment illustrated, gripper 382 is attached to sleeve 380 for gripping tubular stands 80 (see FIG. 8) racked in racking module 300. Sleeve 380 is mounted to arm 370 in vertically translatable relation, as further described below. As described, actuation of rotate actuator 362 causes rotation of gripper 382.

Figure 4:
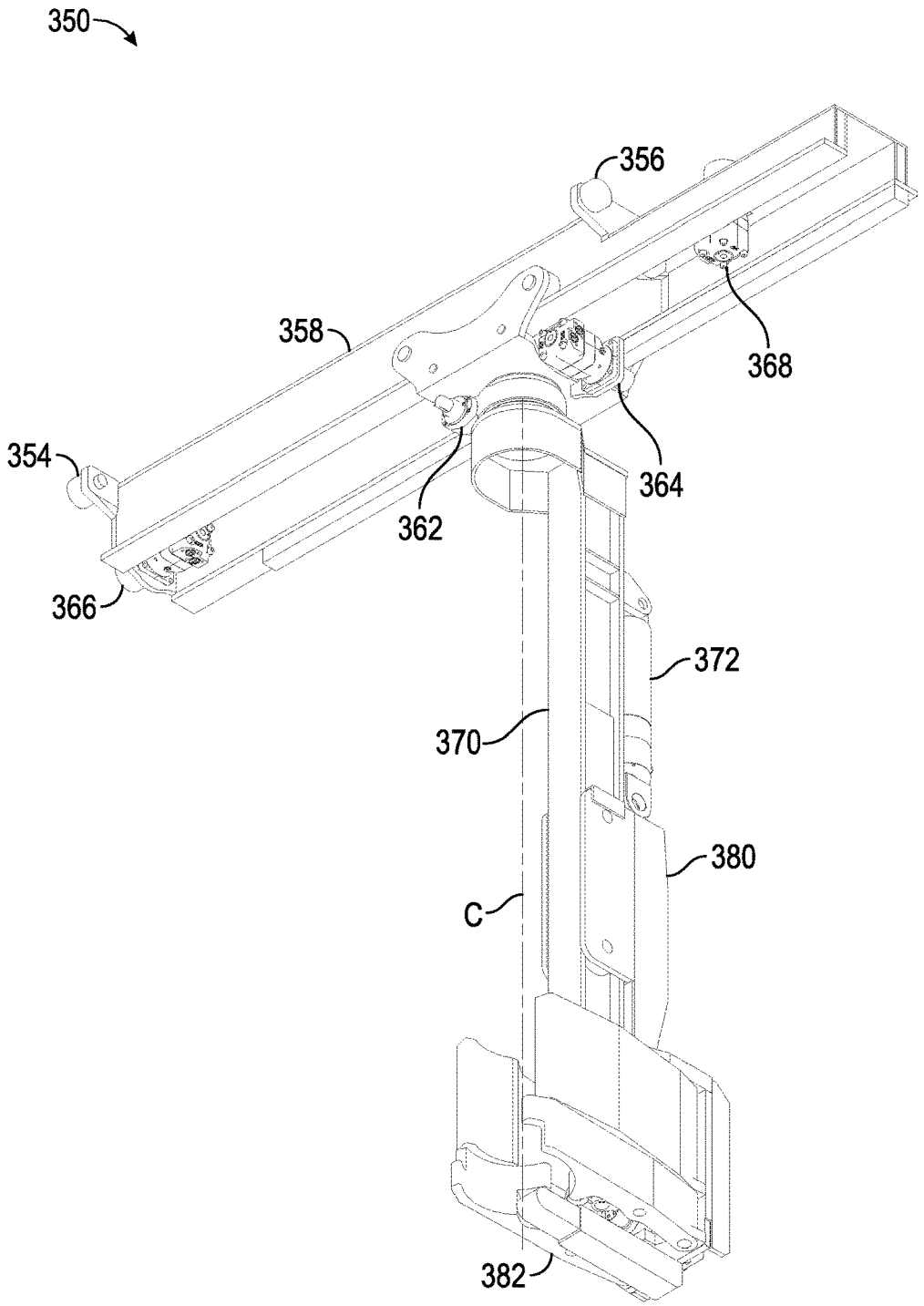
FIG. 4 is an isometric view of the upper racking mechanism of FIGS. 2 and 3, as shown from below to illustrate that the grip centerline of the tubular stand gripped by the upper racking mechanism doesn't move laterally when the arm is rotated.

As best seen in FIG. 4, a rotate actuator centerline C extends downward from the center of rotation of rotate actuator 362. This centerline is common to the centerline C of tubular stands 80 gripped by gripper 382, such that rotation of gripper 382 results in centered rotation of tubular stands 80 without lateral movement.

Returning to FIG. 2, as stated above, sleeve 380 is mounted to arm 370 in vertically translatable relation, such as by slide bearings, rollers, or other connective method.

In the embodiment illustrated, a tandem cylinder assembly 372 is connected between arm 370 and sleeve 380. Tandem cylinder assembly 372 comprises a counterbalance cylinder 374 and a lift cylinder 376. Actuation of lift cylinder 376 is operator controllable with conventional hydraulic controls. Tubular stand 80 is hoisted by retraction of lift cylinder 376. Counterbalance cylinder 374 passively compensates. Counterbalance cylinder 374 is in the extended position when there is no load on gripper 382.

When tubular stand 80 is set down, counterbalance cylinder 374 retracts to provide a positive indication of set down of tubular stand 80. Set down retraction of the counterbalance cylinder 374 is measured by a transducer (not shown) such as a linear position transducer. The transducer provides this feedback to prevent destructive lateral movement of tubular stand 80 before it has been lifted.

Figure 3:
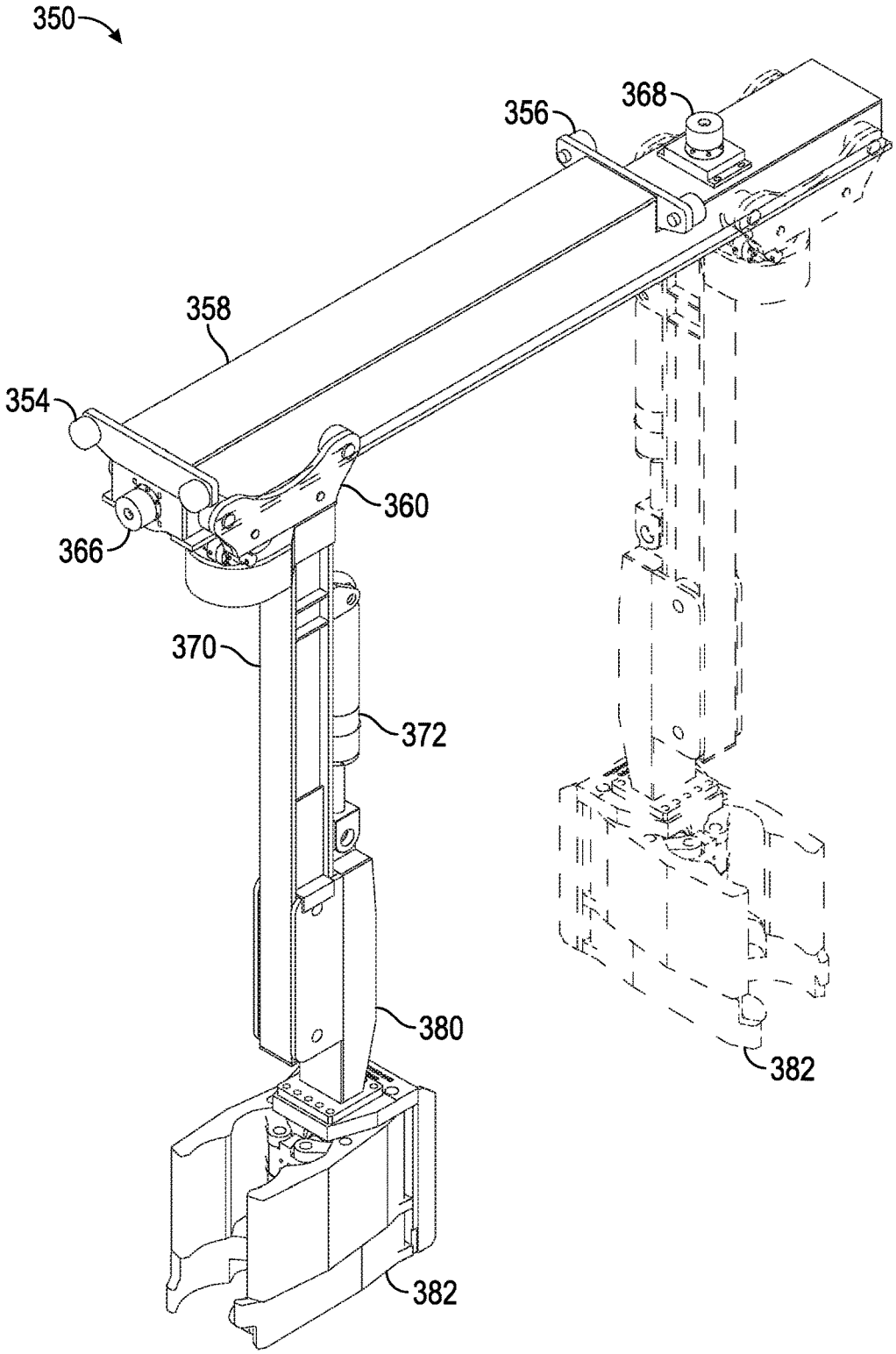
FIG. 3 is an isometric view of the embodiment of the upper racking mechanism of FIG. 2, illustrating the travel range and rotation capability of the arm suspended from the bridge.

FIG. 3 is an isometric view of the embodiment of upper racking mechanism 350 fully assembled, illustrating the travel range and rotation of gripper 382 connected to sleeve 380 and arm 370, and suspended from bridge 358. FIG. 3 illustrates gripper 382 rotated 90 degrees by rotate actuator 362 in a broken line figure for comparison.

FIG. 4 is an isometric view of an embodiment of upper racking mechanism 350, shown from below. In this view, it is seen that centerline C is the centerline of rotation of both rotary actuator 362 and tubular stand 80 secured by gripper 382 ("grip centerline"). By this feature, centerline C of tubular stand 80 gripped by upper racking mechanism 350 doesn't move laterally when arm 370 and gripper 382 are rotated. This configuration provides movement within fingerboard platform 314 (see FIG. 7). This configuration also permits connected and coordinated control of the lower end of tubular stand 80 by means of a lower racking mechanism, if desired. This configuration positions tubular stand 80 under the center of bridge 358 during movement to avoid deflection and enhance precision of the location of tubular stand 80.

Figure 5:
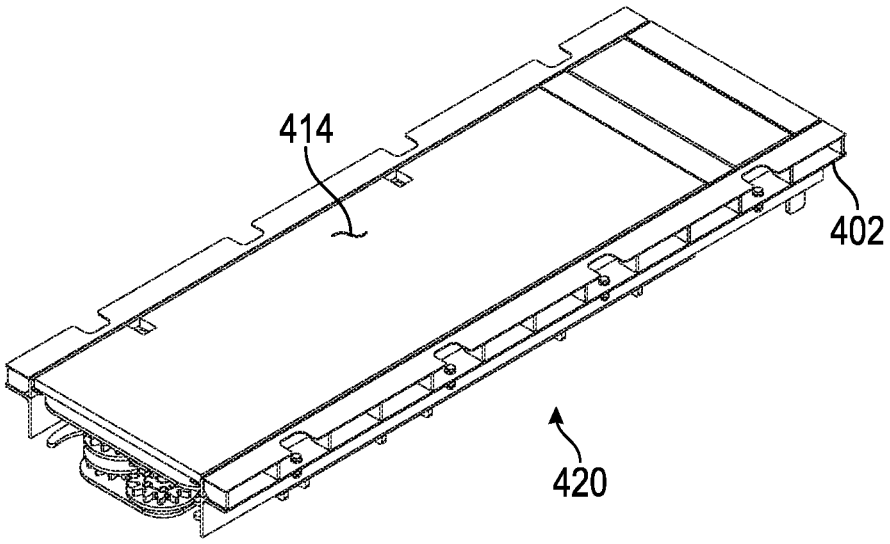
FIG. 5 is an isometric view of an embodiment of an upper stand constraint, illustrating the carriage retracted and the clasp open, as it would be when receiving a tubular stand.

FIG. 5 is an isometric view of an embodiment of an upper stand constraint 420. Upper stand constraint 420 can be integrated into racking module 300. Upper stand constraint 420 has a frame 402. An optional surface 414 forms the top of upper stand constraint 420.

Figure 6:
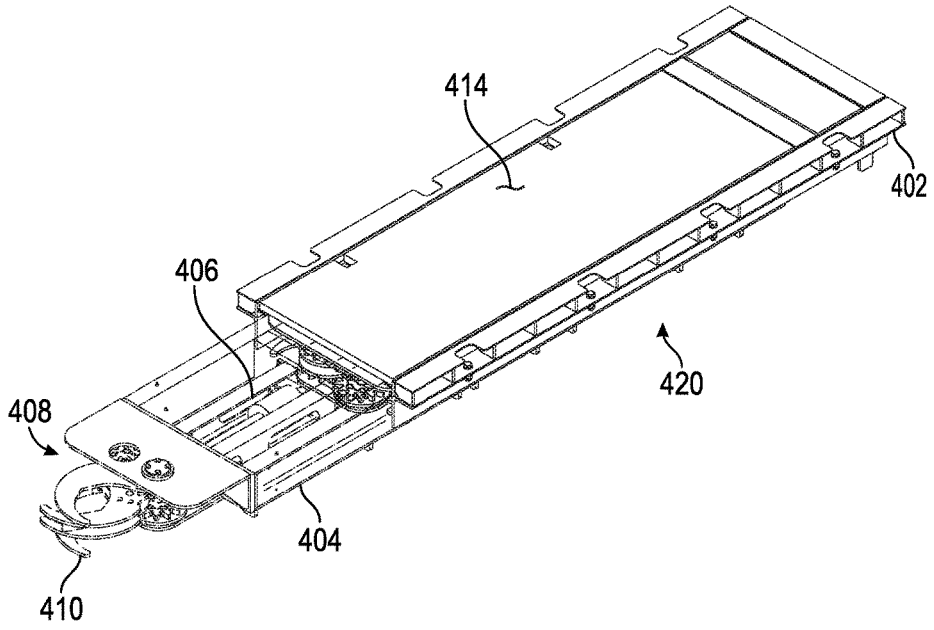
FIG. 6 is an isometric view of the upper stand constraint of FIG. 5, illustrating the carriage extended and the clasp closed, as it would be around a tubular stand.

FIG. 6 is an isometric view of upper stand constraint 420 of FIG. 5, illustrating a carriage 404 connected to frame 402 in an extendable relationship. In the view illustrated, carriage 404 is extended from frame 402. A carriage actuator 406 is connected between frame 402 and carriage 404 and is operable to extend and retract carriage 404 from frame 402. A clasp 408 is pivotally connected to the end of carriage 404. A clasp actuator (not shown) is operable to open and close clasp 408.

Clasp 408 may be self-centering to permit closure of clasp 408 around a full range of drilling tubulars 80, including casing, drill collars and drill pipe. Clasp 408 need not resist vertical movement of tubular stand 80. In one embodiment, clasp 408 comprises opposing claws 410. As seen in FIGS. 7-12, surface 414 of upper stand constraint 420 may serve as fingerboard platform 314 on racking module 300.

Figure 7:
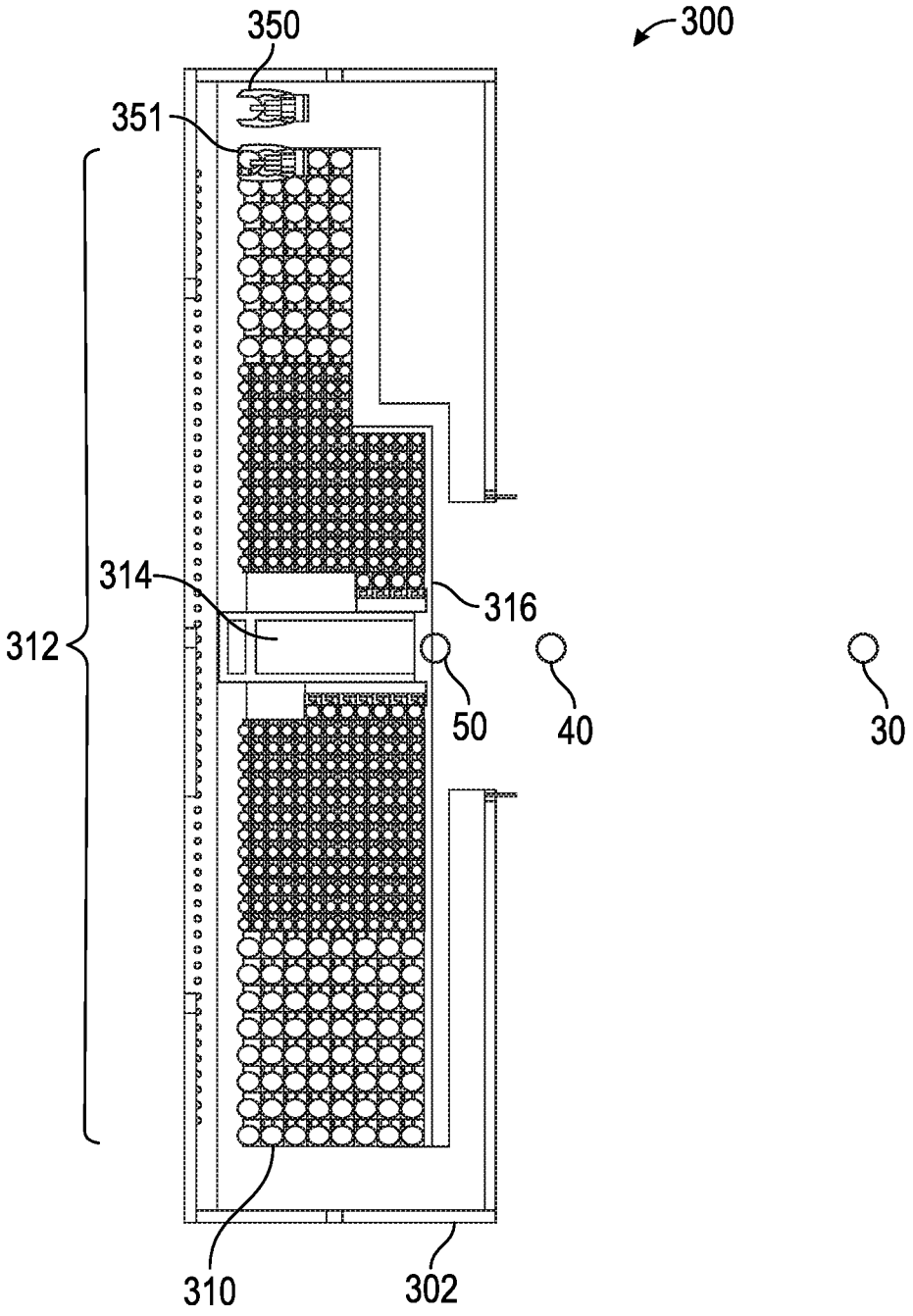
FIG. 7 is a top view of the racking module of FIG. 8, illustrating the operating envelope of the upper racking mechanism and the relationship of the racking module, upper racking mechanism, and upper stand constraint to a stand hand-off position.
Figure 8:
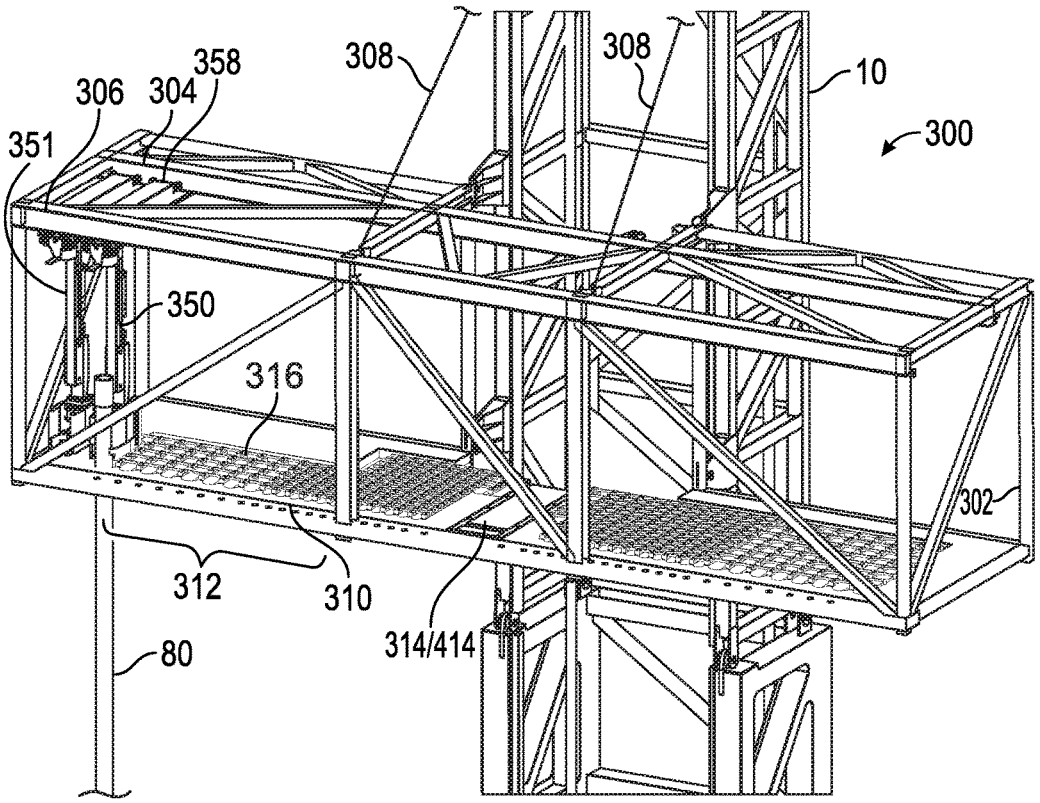
FIG. 8 is an isometric view of an embodiment of the racking module as connected to the front side of a mast of a drilling rig, and illustrating the upper racking mechanism gripping a tubular stand (e.g., a stand of drill pipe) in its racked location for delivery to a stand hand-off position.

FIG. 7 is a top view of racking module 300 of FIG. 8, illustrating the operating envelope of upper racking mechanism 350 and the relationship of racking module 300, upper racking mechanism 350, and upper stand constraint 420 to the stand hand-off position 50. As shown, a mousehole 40 is positioned between stand hand-off position 50 and well center 30.

In this view, carriage 404 of upper stand constraint 420 is retracted beneath surface 414, which is acting as fingerboard platform 314. Upper stand constraint 420 has the ability to extend carriage 404 and clasp 408 over stand hand-off position 50, and further towards well center 30 so as to tilt tubular stand 80 towards well center 30 sufficiently to render it accessible to a top drive on drilling rig 1. This allows upper stand constraint 420 to act as a redundant mechanism to failure of a tubular delivery arm that may be mounted to a front side of mast 10 if one is provided. Upper stand constraint 420 can also be used to deliver tubular stands 80 comprising drill collars and other stands of heavy tubulars that exceed the lifting capacity of a tubular delivery arm.

Conventional fingerboard assemblies have rows for racking tubular stands 80 that run in an orientation of driller's side to off-driller's side. Contrary to conventional fingerboard assemblies, racking module 300 has a fingerboard assembly 310 comprising a plurality of columns of racking positions 312 on each side of fingerboard platform 314, which are oriented in a V-door to drawworks orientation. This orientation is perpendicular to that of conventional fingerboards. In this configuration, the fingers of fingerboard assembly 310 are shorter, and there are more of them. Shorter fingers deflect less and may support assembled casing stands. Additionally, racking module 300 is scalable in this configuration, providing a longer racking module 300 for deeper drilling that is still a single transportable unit.

FIG. 8 is an isometric view of an embodiment of racking module 300 as connected to a front side of a mast 10 of a drilling rig 1. FIG. 8 illustrates upper racking mechanism 350 gripping tubular stand 80 in its racked location within fingerboard assembly 310 for delivery to a stand hand-off position 50. An alleyway 316 connects to columns of racking positions 312 and provides a passage for moving tubular stands 80 between a resting position in fingerboard assembly 310 and stand hand-off position 50.

In this embodiment, upper stand constraint 420 is located beneath fingerboard platform 314, which may also be surface 414. Upper stand constraint 420 acts to secure tubular stand 80 in place at stand hand-off position 50.

Racking module 300 has a modular frame 302 comprising an inner runway 304 and outer runway 306. As seen in FIG. 8, and referring to FIG. 2, inner roller assembly 356 and inner pinion drive 368 connect bridge 358 to inner runway 304. Similarly, outer roller assembly 354 and outer pinion drive 366 connect bridge 358 to outer runway 306. In this manner, upper racking mechanism 350 may translate horizontally in the driller's side to off-driller's side directions substantially across the length of racking module 300. This is accomplished by actuation of inner pinion drive 368 and outer pinion drive 366. Inner roller assembly 356 and outer roller assembly 354 transfer the weight of tubular stand 80 and upper racking mechanism 350 to bridge 358 of racking module 300.

As shown in FIG. 8, a second upper racking mechanism 351 can be provided for mechanical redundancy and optionally for coincident work. One option is to have gripper 382 of upper racking mechanism 351 different in tubular gripping capability to that of gripper 382 of upper racking mechanism 350. Another option is to coordinate synchronous movement between upper racking mechanisms 350 and 351 for handling similar tubular stands 80 racked in separate locations of fingerboard assembly 310. Upper racking mechanisms 350 and 351 may each be capable of transporting tubular stands 80 from any position on fingerboard assembly 310 to stand hand-off position 50.

Figure 9:
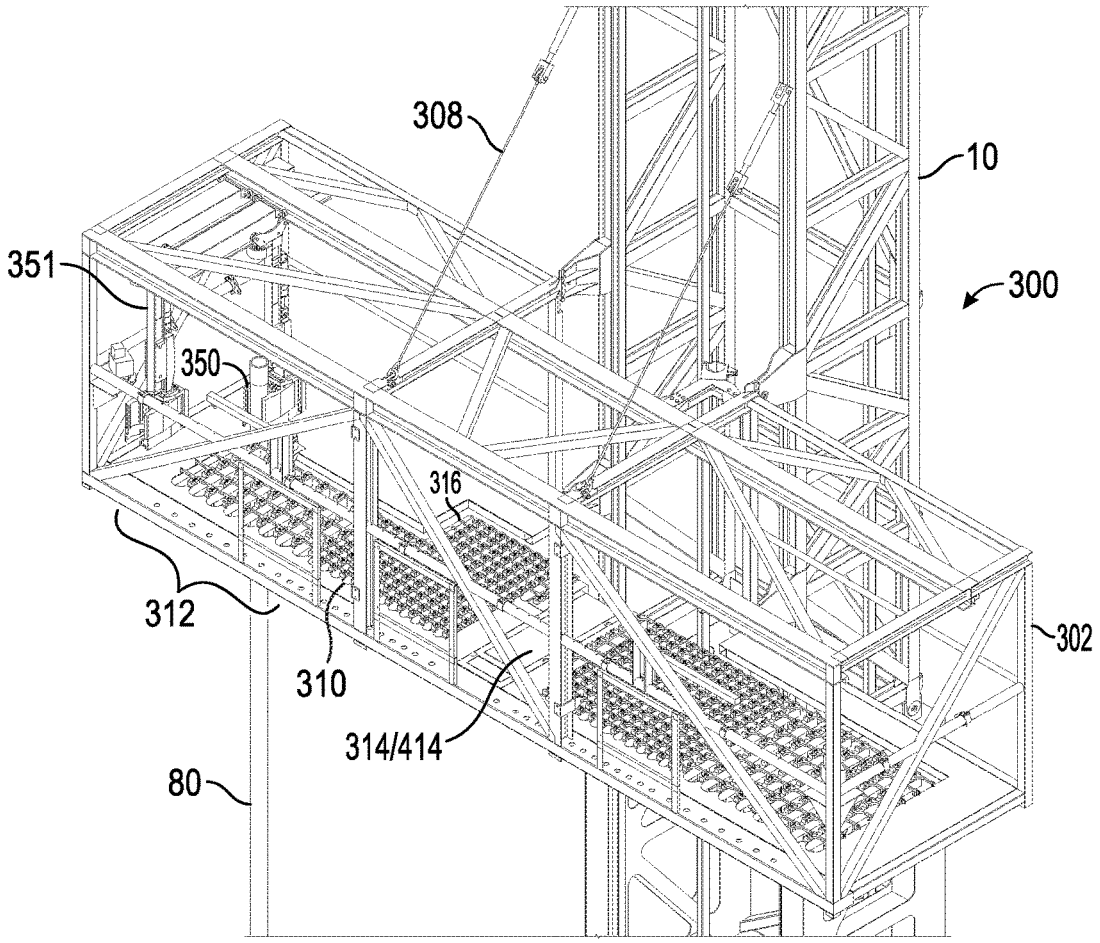
FIG. 9 is an isometric view of an embodiment of the racking module, illustrating the upper racking mechanism moving the tubular stand from its racked position to an alleyway on the fingerboard assembly.

FIG. 9 is an isometric view of racking module 300 of FIG. 8, illustrating upper racking mechanism 350 moving tubular stand 80 to alleyway 316 of fingerboard assembly 310. As seen in this and other views, a pair of tension cables 308 is connected between frame 302 of racking module 300 and mast 10 of drilling rig 1. Cables 308 reduce the high tension and shear forces acting on connections between frame 302 and mast 10 that are unknown to conventional racking modules on conventional drilling rigs. Racking module 300 bears the additional weight to two upper racking mechanisms 350 and 351, as well as potentially two tubular stands 80. Cables 308 take advantage of the load capacity of mast 10 to safely secure racking module 300 in place, and to reduce undesirable movement of racking module 300.

Figure 10:
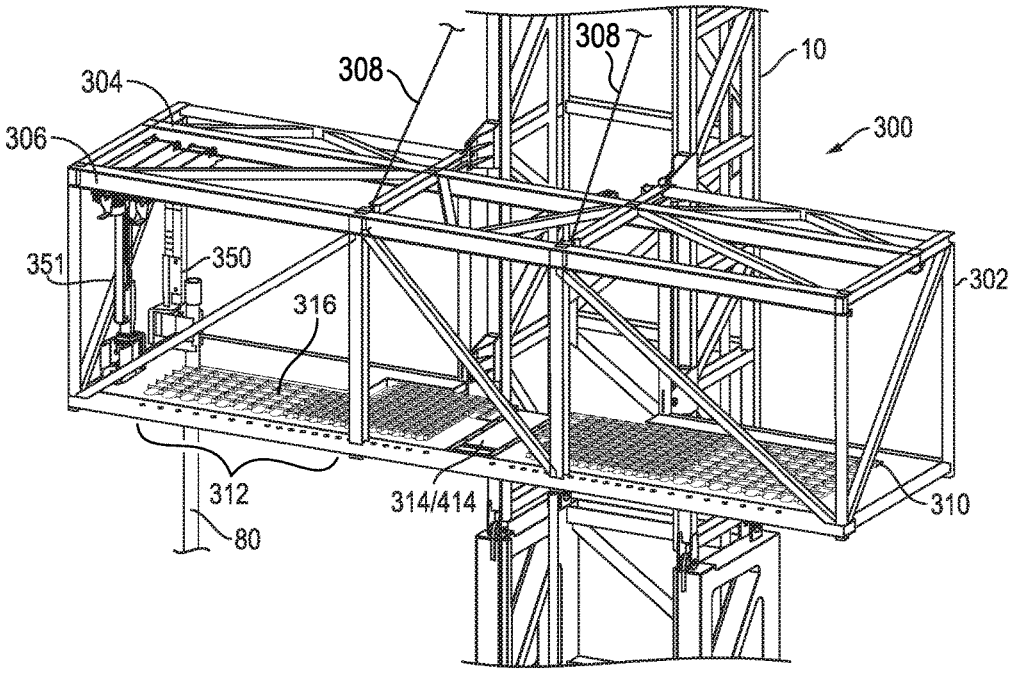
FIG. 10 is an isometric view of an embodiment of the racking module, illustrating the upper racking mechanism rotating the tubular stand ninety degrees counterclockwise at the alleyway.

FIG. 10 is an isometric view of an embodiment of racking module 300, illustrating upper racking mechanism 350 rotating tubular stand 80 in alleyway 316. As was illustrated in FIGS. 3 and 4, rotate actuator 362 rotates arm 370. The coincident centerlines C of rotate actuator 362 and tubular stand 80 secured by gripper 382 ("grip centerline") prevent lateral movement of tubular stand 80 during rotation.

Figure 11:
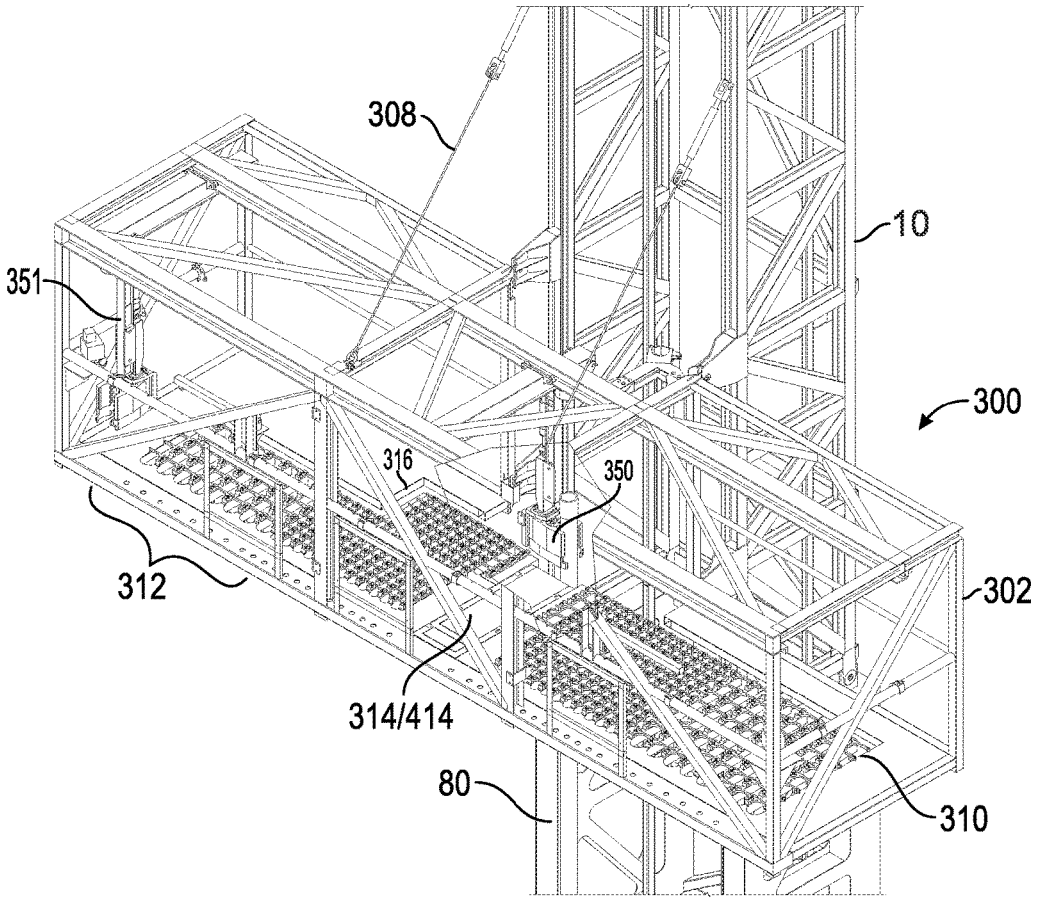
FIG. 11 is an isometric break-out view of an embodiment of the racking module, illustrating the upper racking mechanism translating the alleyway and delivering the tubular stand to the stand hand-off position.

FIG. 11 is an isometric break-out view of an embodiment of racking module 300, with a portion of frame 302 removed for visibility. This view illustrates upper racking mechanism 350 traversing alleyway 316 to stand hand-off position 50 at the front side of mast 10.

Figure 12:
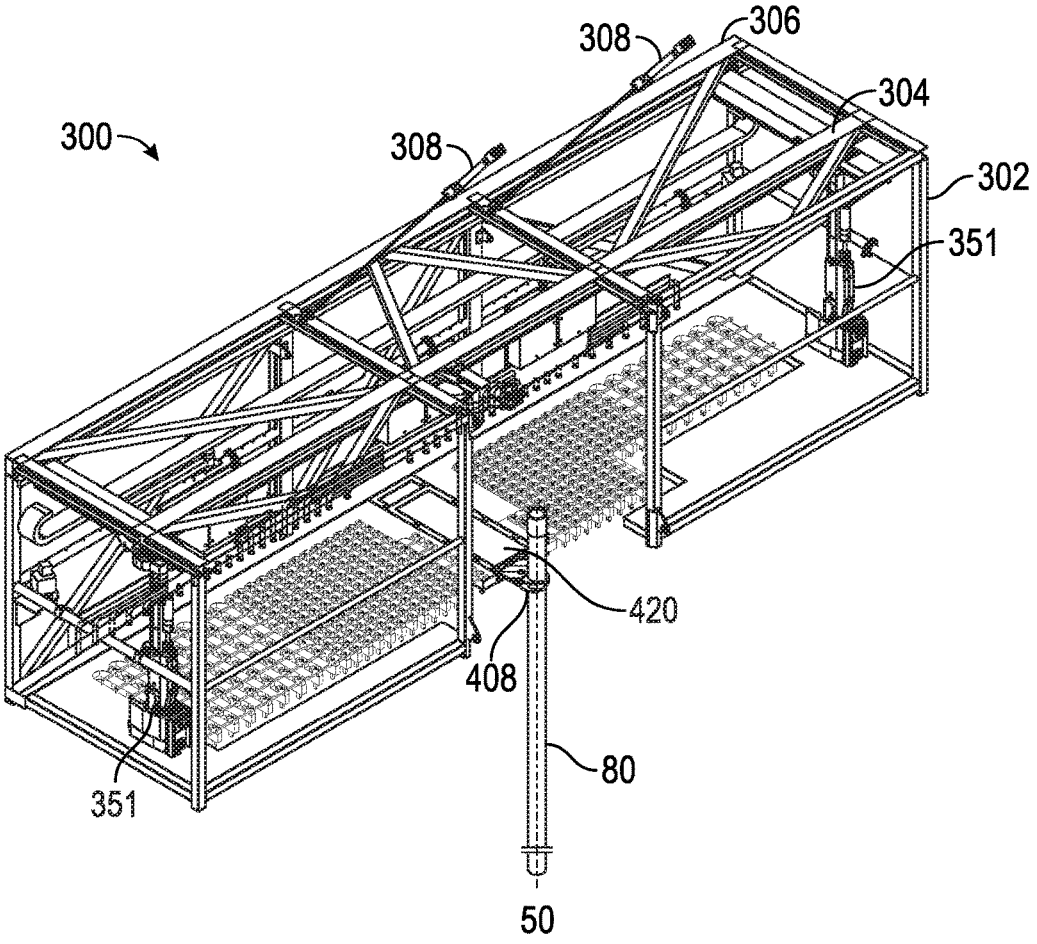
FIG. 12 is an isometric view of an embodiment of the racking module, shown from the opposite side to illustrate the upper stand constraint holding the tubular stand at the stand hand-off position and the release of the tubular stand and departure of the upper racking mechanism.

FIG. 12 is an isometric view of racking module 300 of FIGS. 8-11, shown from the opposite side to illustrate clasp 408 of upper stand constraint 420 holding tubular stand 80 at stand hand-off position 50. After lowering tubular stand 80 at stand hand-off position 50, upper racking mechanism 350 has released tubular stand 80 and departed to retrieve the next tubular stand 80.

Figure 13:
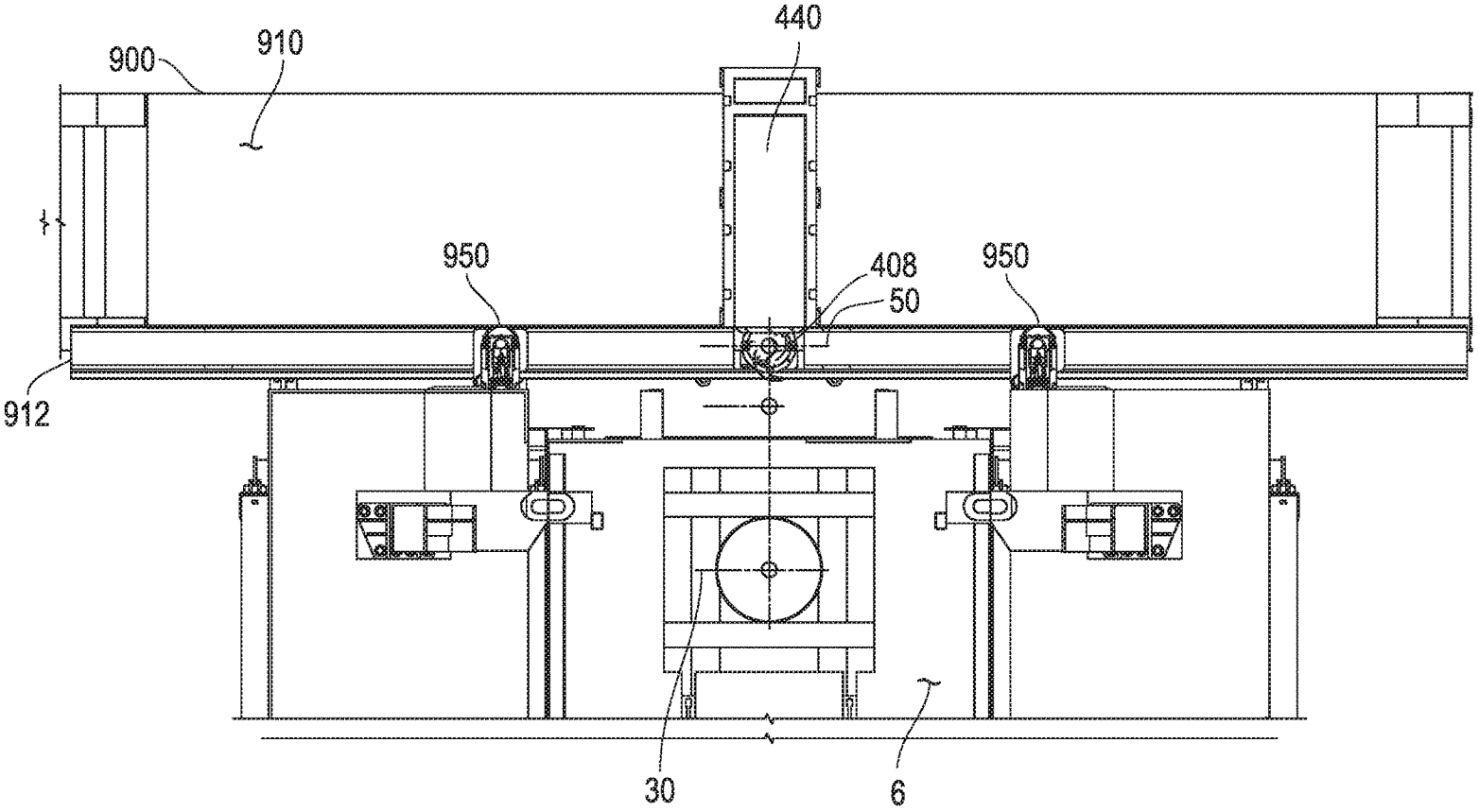
FIG. 13 is a top view of an embodiment of a setback platform shown in relationship to a drill floor location, well center, and stand hand-off position.

FIG. 13 is a top view of setback platform 900, shown in relationship to drill floor 6. As seen in this figure, stand hand-off position 50 is located generally central to an alleyway 912 on setback platform 900. In the embodiment illustrated, mousehole center 40 is between stand handoff position 50 and well center 30. A clasp 408 of a lower stand constraint 440 is located over stand hand-off position 50, and is retractable to a position behind it, and extendable to mousehole center 40.

Figure 14:
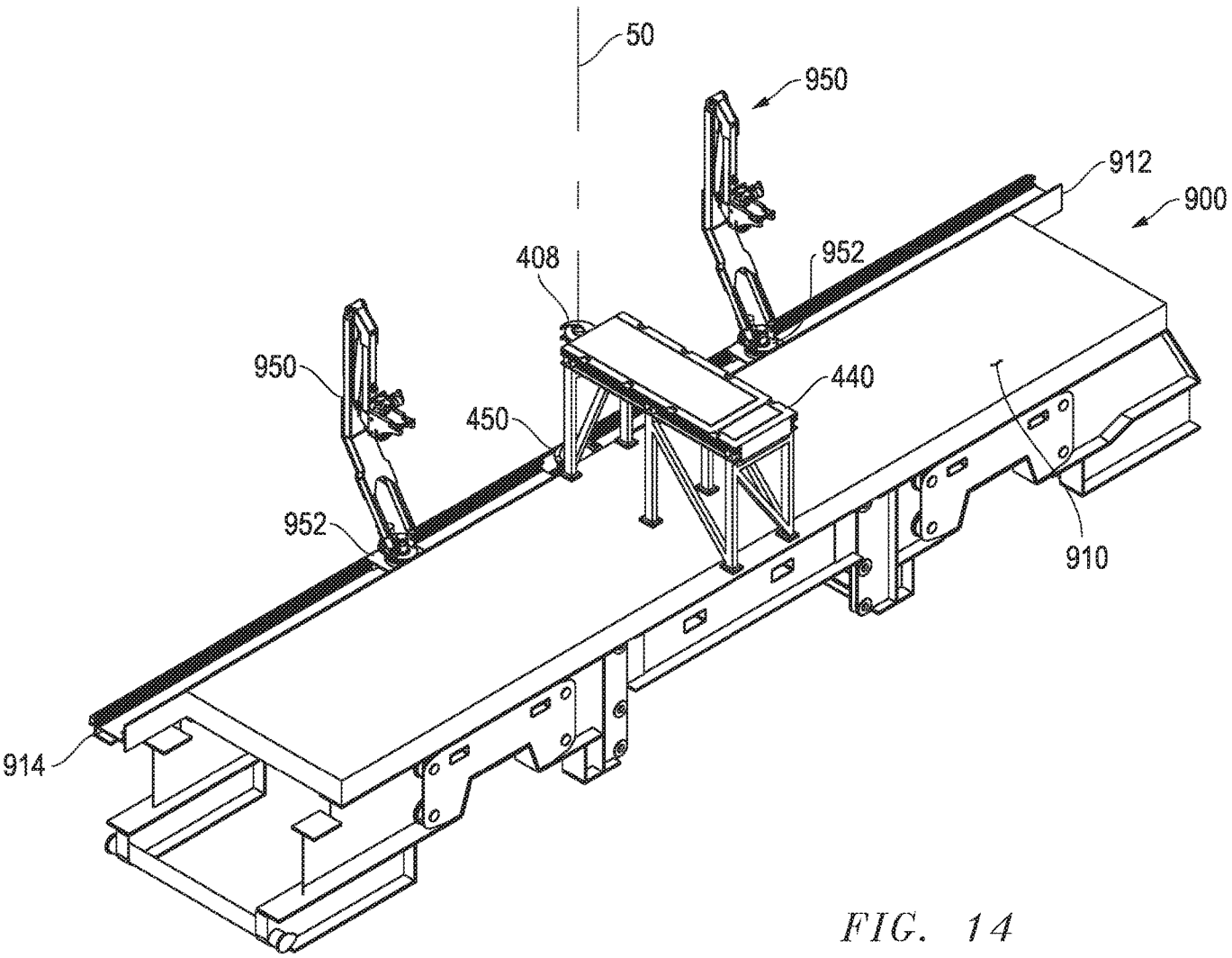
FIG. 14 is an isometric view of an embodiment of a setback platform of the tubular racking system.

FIG. 14 is an isometric view of setback platform 900 of the tubular racking system. Setback platform 900 comprises platform 910 for vertical storage of tubular stands 80 (not shown). Platform 910 has a mast side and an opposite catwalk side. An alleyway 912 extends along the mast side of platform 910. In the embodiment shown, alleyway 912 is offset below platform 910. Stand hand-off station 450 is located on alleyway 912.

A lower racking mechanism 950 is translatably located in alleyway 912. In the embodiment illustrated, a geared rail 914 is affixed to alleyway 912. Lower racking mechanism 950 is rotatably connected to a base 952 that is translatably connected to rail 914.

Figure 15:
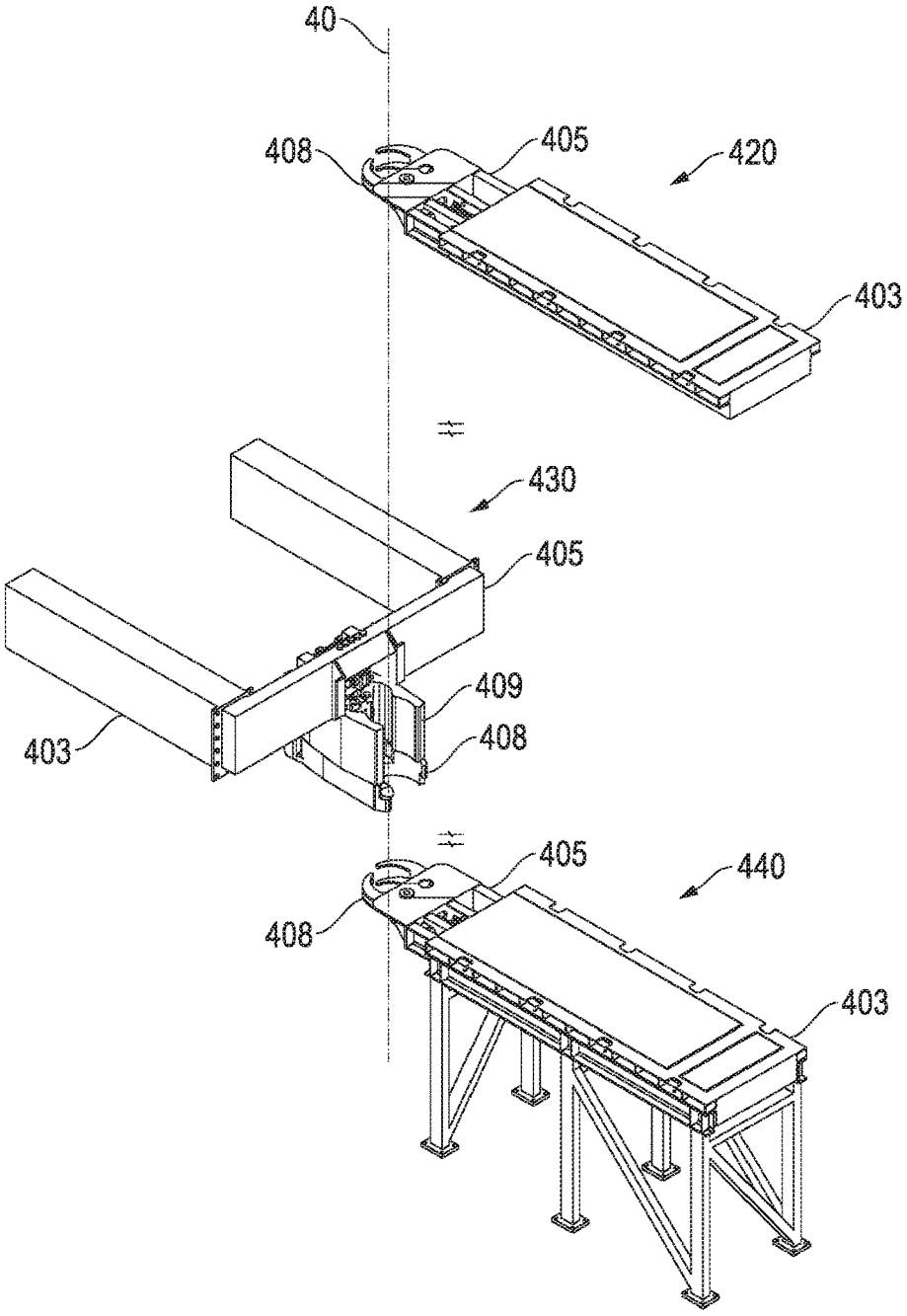
FIG. 15 is an exploded isometric view of the upper stand constraint, an intermediate stand constraint, and a lower stand constraint, illustrating their combined ability to reach tubular stands at the mousehole centerline, as well as the stand handoff centerline.

FIG. 15 is an exploded isometric view of upper stand constraint 420, intermediate stand constraint 430, and lower stand constraint 440, illustrating their combined ability to reach tubular stands 80 at mousehole centerline 40, as well as stand handoff centerline 50.

Intermediate stand constraint 430 as shown in this embodiment can be positioned proximate to drill floor 6, as illustrated in FIG. 1. Intermediate stand constraint 430 has a frame 403 that may be configured as a single unit or as a pair, as illustrated. Frame 403 receives a carriage 405 connected to frame 403 in an extendable relationship. In the view illustrated, carriage 405 is retracted inside frame 403. As with upper stand constraint 420 and lower stand constraint 440, a clasp 408 is pivotally connected to the end of carriage 405. A clasp actuator (not visible) is operable to open and close clasp 408.

Clasp 408 is preferably self-centering to permit closure of clasp 408 around a full range of drilling tubulars 80, including casing, drill collars and drill pipe. Clasp 408 need not resist vertical movement of tubular stand 80.

A carriage actuator 407 (not visible) is connected between frame 403 and carriage 405 and is operable to extend and retract carriage 405 from frame 403. As distinguished from upper stand constraint 420 and lower stand constraint 440, intermediate stand constraint 430 includes a tubular gripping assembly 409 that is capable of supporting the vertical load of tubular stand 80 and preventing downward vertical movement of tubular stand 80. This provides the capability for making up tubular stands 80 over mousehole 40.

Figure 16:
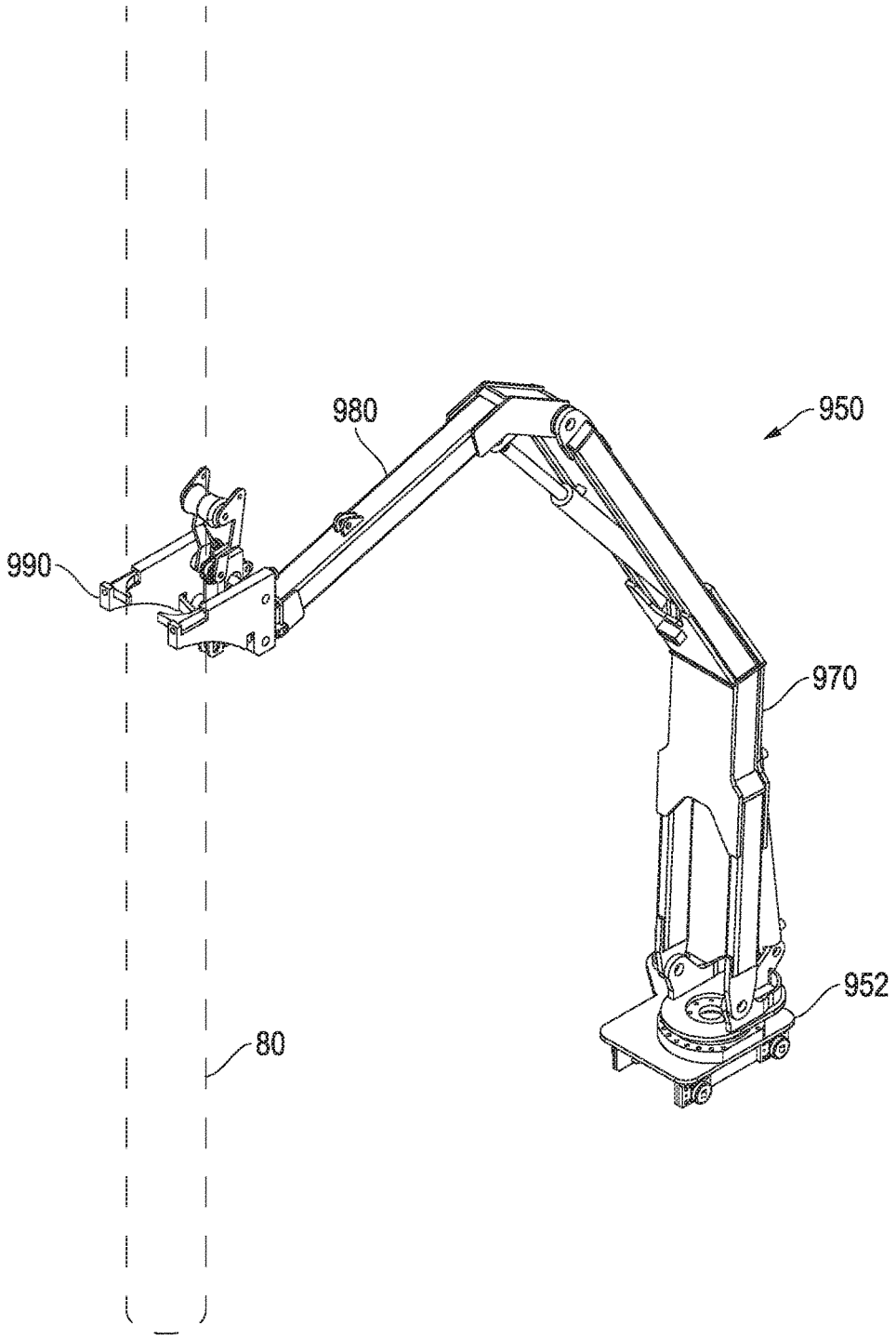
FIG. 16 is an isometric view of an embodiment of a lower racking mechanism of the tubular racking system.

FIG. 16 is an isometric view of an embodiment of lower racking mechanism 950 of the automated tubular racking system. Lower racking mechanism 950 is rotatable, extendable and retractable, and translatable along alleyway 912. In this manner, lower racking mechanism 950 can clasp a tubular stand 80 and match the lateral movements of upper racking mechanisms 350, 351 to stabilize tubular stand 80 during movement between stand hand-off position 50 and a racked position on platform 910.

Lower racking mechanism 950 has a base 952 translatably located in alleyway 912. A frame 970 is pivotally and rotatably connected to base 952. Rotation of base 952 rotates frame 970 with base 952. Frame 970 may also be pivoted above and across base 952. An arm 980 is pivotally connected to frame 970 to permit extension and retraction of arm 980. A clasp 990 is pivotally connected to arm 980 for clasping to a tubular stand 80 (hidden lines) as shown.

Figure 17:
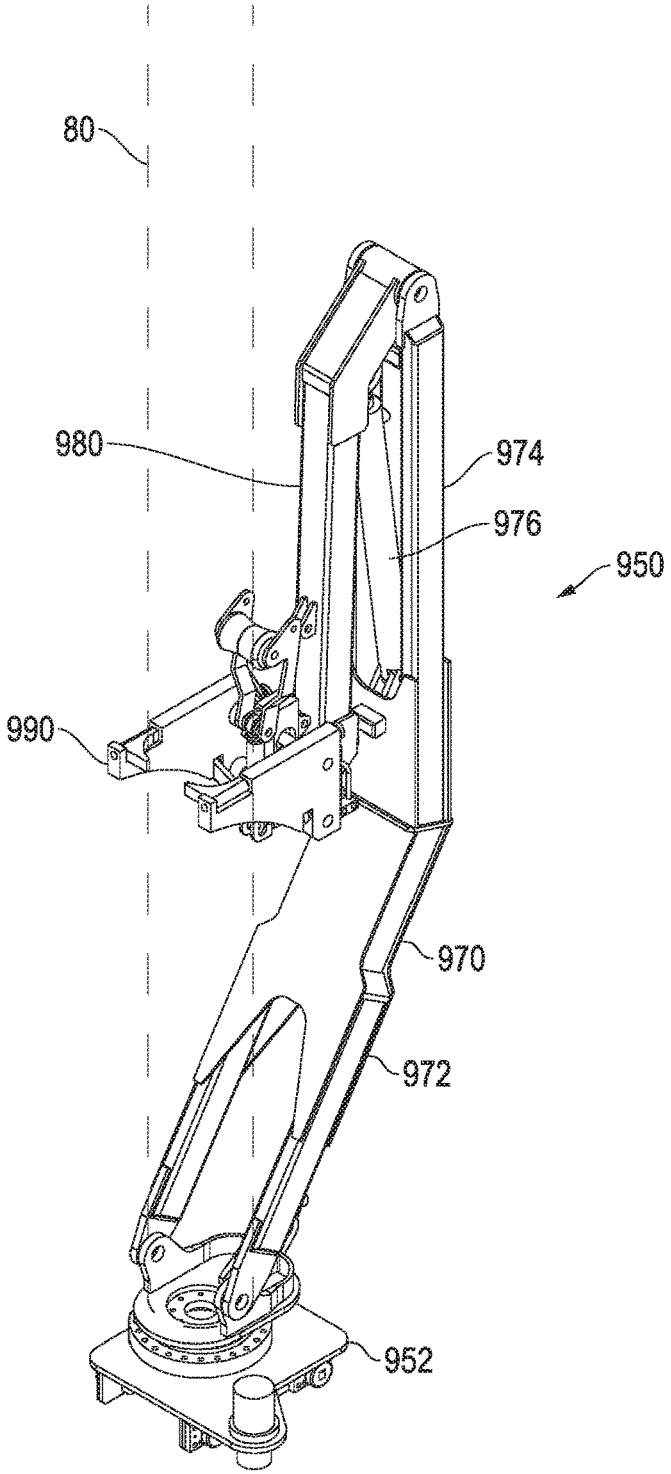
FIG. 17 is an isometric view of an embodiment of the lower racking mechanism retracted for rotation, with the tubular stand centerline coincident with the centerline of the axis of rotation of the lower racking mechanism.

FIG. 17 is an isometric view of the embodiment of lower racking mechanism 950, illustrating lower racking mechanism 950 retracted for rotation, with tubular stand 80 centered coincident to the rotation of lower racking mechanism 950. This centered rotation capability permits lower racking mechanism 950 to rotate as upper racking mechanism 350 rotates, without other horizontal or vertical movement of tubular stand 80.

Figure 18:
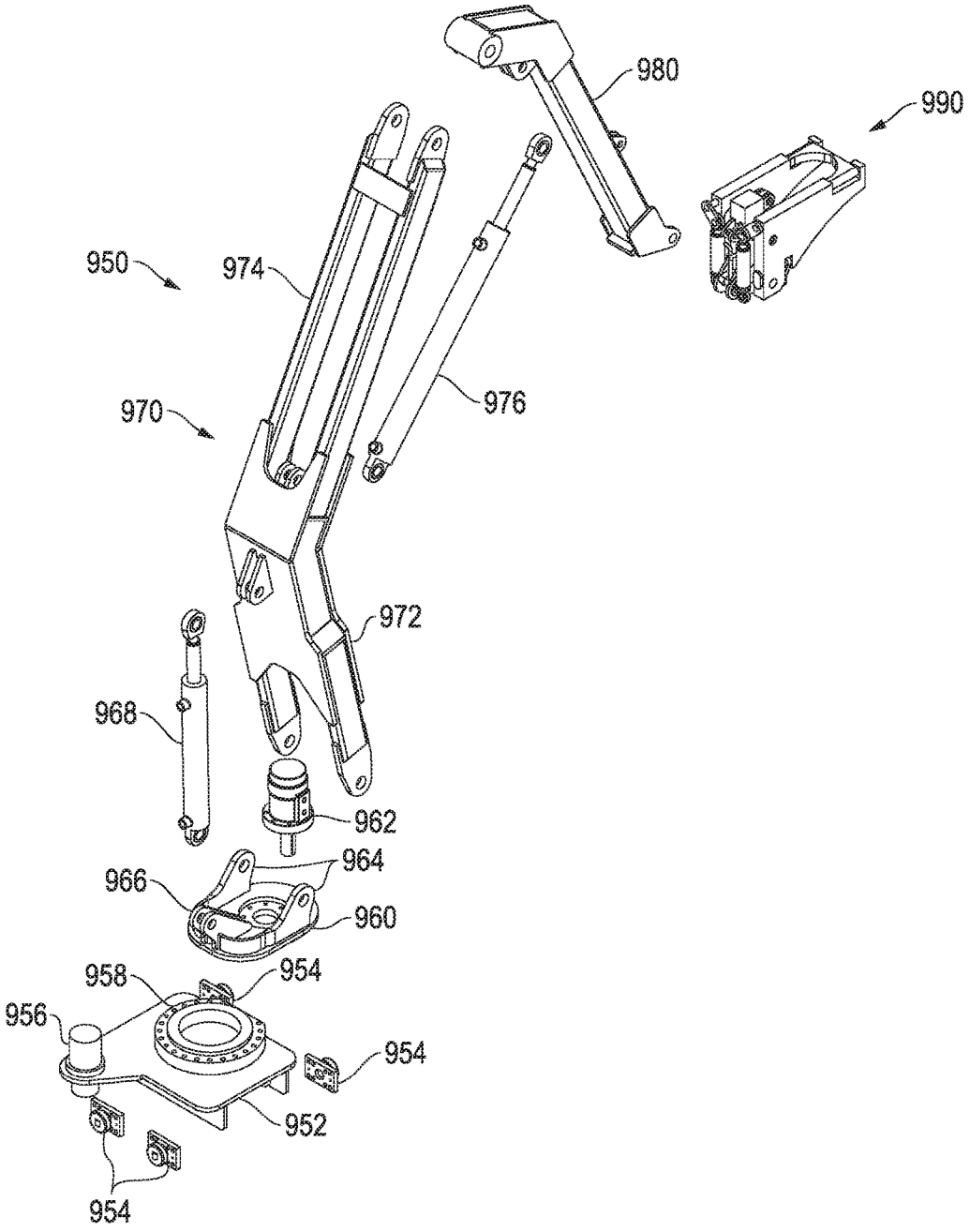
FIG. 18 is an exploded isometric view of the embodiment of the lower racking mechanism of FIGS. 16 and 17.

FIG. 18 is an exploded isometric view of the embodiment of lower racking mechanism 950 disclosed in FIGS. 16 and 17. As stated above, lower racking mechanism 950 has base 952 translatably connected to rail 914. Rollers 954 may be attached to base 952 for engagement with alleyway 912. A pinion drive 956 engages rail 914 of alleyway 912 to translate lower racking mechanism 950 along alleyway 912. A slew drive 958 is connected to base 952. A rotate frame 960 engages slew drive 958. A rotate motor 962 rotates rotate frame 960 on slew drive 958.

In the embodiment illustrated, rotate frame 960 has three generally triangulated pivot connections, frame pivots 964 (2) and actuator pivot 966. Frame 970 is comprised of two fork-shaped sections, lower fork 972 and upper fork 974. Lower fork 972 and upper fork 974 form at an obtuse angle. A frame actuator 968 is operable to pivot frame 970 forward, and to retract it backwards.

Arm 980 is pivotally connected to frame 970. An arm actuator 976 extends and retracts arm 980 relative to frame 970. A clasp 990 is pivotally connected to the opposite end of arm 980.

Figure 19:
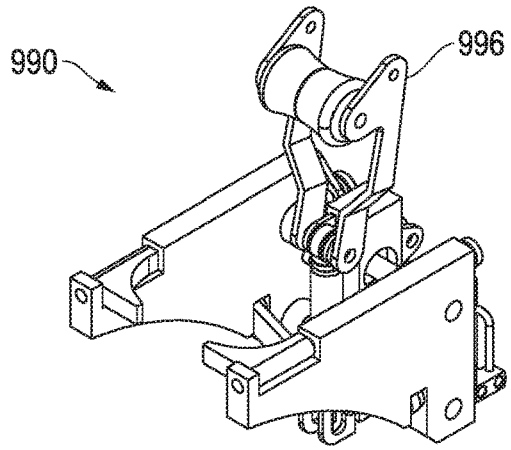
FIG. 19 is an isometric view of an embodiment of a clasp of the lower racking mechanism.
Figure 20:
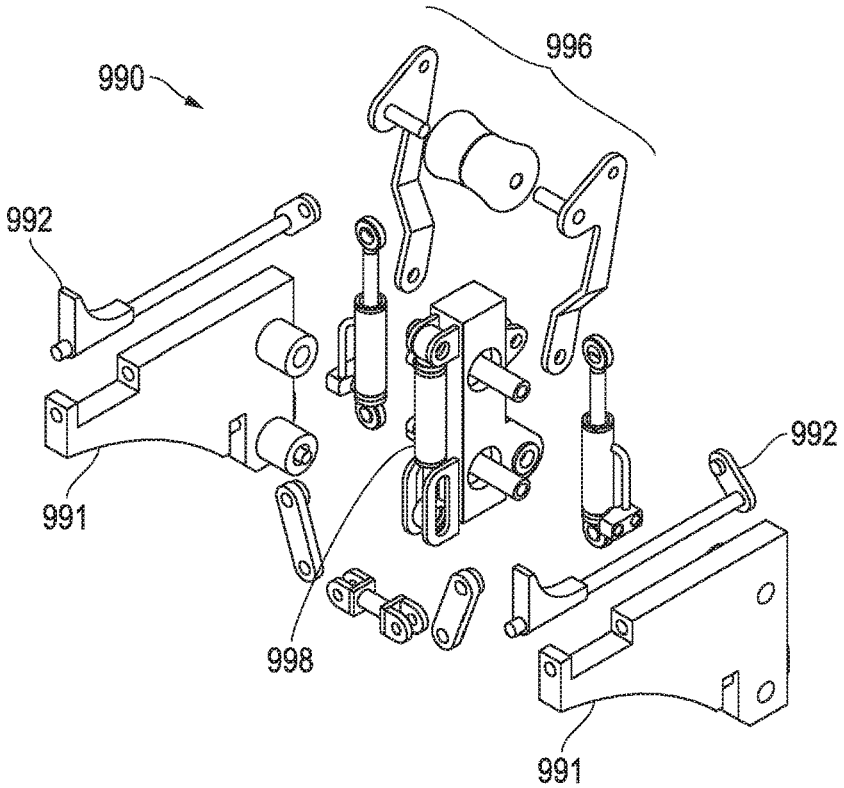
FIG. 20 is an exploded isometric view of the embodiment of the clasp of the lower racking mechanism of FIG. 19.

FIG. 19 is an isometric view of an embodiment of clasp 990 of lower racking mechanism 950. FIG. 20 is an exploded isometric view of clasp 990 of the lower racking mechanism of FIG. 19. Clasp 990 has a pair of opposing paddles 991. A latch 992 is pivotally attached to each paddle 991. A central roller assembly 996 is connected between paddles 991 for centering against tubular stand 80 captured by clasp 990. A latch actuator 998 operates clasp 990 to secure it on tubular stand 80.

Figure 21:
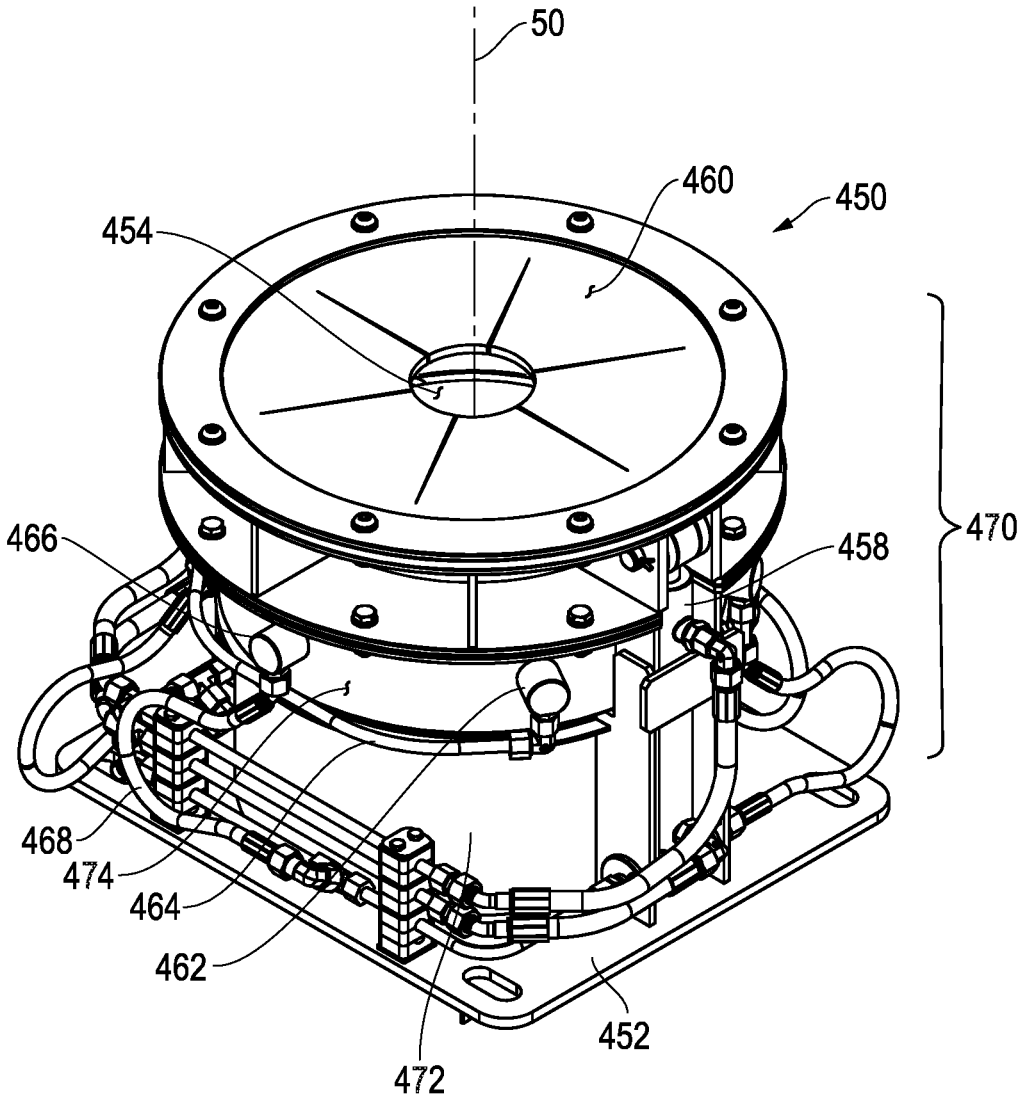
FIGS. 21(1)-21(7) are side view schematics showing the operation of the automated tubular racking system, and illustrating the cooperative operation of the upper racking mechanism and the lower racking mechanism.

FIG. 21 is an isometric view of stand hand-off station 450. Referring to the embodiment illustrated in FIG. 14, stand hand-off station 450 is located at stand hand-off position 50, in alleyway 912. Alleyway 912 may be set vertically below surface 910. This permits positioning of stand hand-off station 450 below surface 910 so that tubular stand 80 need not be raised a significant distance by upper racking mechanism 350 to obtain access to stand hand-off station 450.

Referring back to FIG. 21, stand hand-off station 450 has a base 452. In the embodiment illustrated, an expandable chamber assembly 470 comprises a lower chamber 472 connected to base 452, and an upper chamber 474 positioned in concentric relationship to lower chamber 472. A chamber actuator 458 is connected between lower chamber 472 and upper chamber 474.

A stage 454 is located inside chamber assembly 470. Stage 454 is receivable of the threaded pin end of tubular stand 80. An elastomeric seal 460 may be located over a top end of upper chamber 474. Seal 460 has an opening for receiving the threaded pin end of tubular stand 80.

In one embodiment, a grease nozzle 462 is directed towards the interior of chamber assembly 470. A grease supply line 464 is connected to grease nozzle 462 for supplying pressurized grease to grease nozzle 462.

In one embodiment, a wash nozzle 466 is directed towards the interior of chamber assembly 470. A wash supply line 468 is connected to wash nozzle 466 for supplying pressurized washing fluid to wash nozzle 466. A drain 456 (not shown) may be connected to the interior of chamber assembly 470 for collection and removal of wash residue.

In operation, chamber actuator 458 is in the contracted position. The threaded pin end of tubular stand 80 is lowered through the opening of seal 460 and onto stage 454, which receives and supports the weight of tubular stand 80. Chamber actuator 458 is actuated to raise upper chamber 474 upwards to a proper height to cover the threads of the pin connection. In this position, a wash cycle may be activated in which a washing fluid is provided through wash supply line 468 and is sprayed through wash nozzle 466 onto the threaded pin portion of tubular stand 80. Residual wash fluid passes through drain 456 for recycling or disposal. Similarly, a doping cycle may be initiated to spray a protective grease layer through grease nozzle 462 and onto the pin connection of tubular stand 80.

Figures 2, 22:
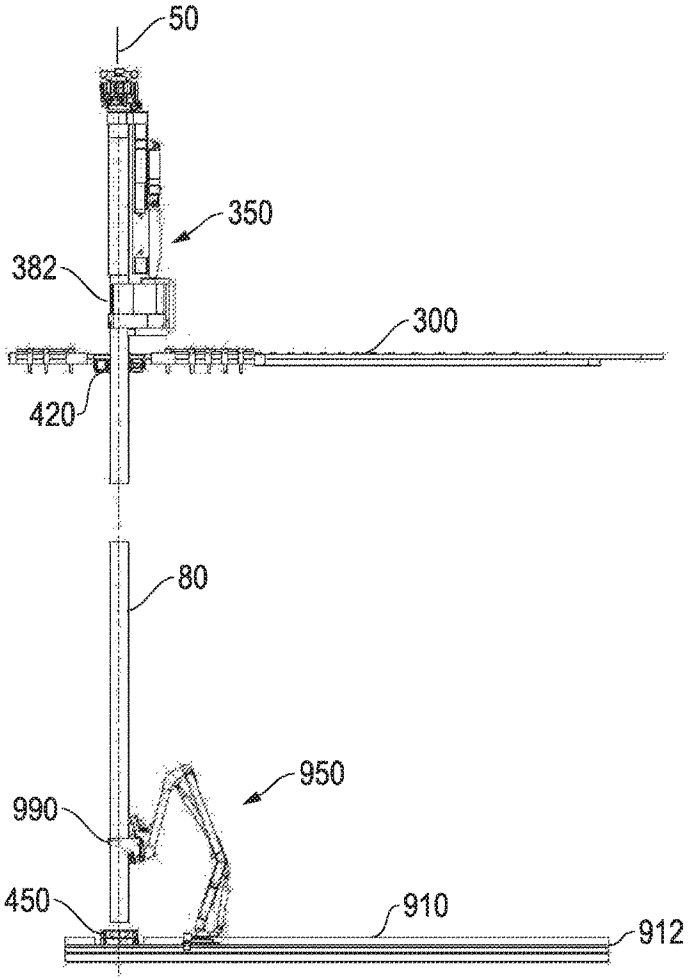
FIG. 22 is an isometric view of FIG. 21(1), illustrating a tubular stand at the stand hand-off position, and held by the upper stand constraint, and engaged by the upper racking mechanism and the lower racking mechanism. Optional engagement with a lower stand constraint is not shown.
Figures 1, 22:
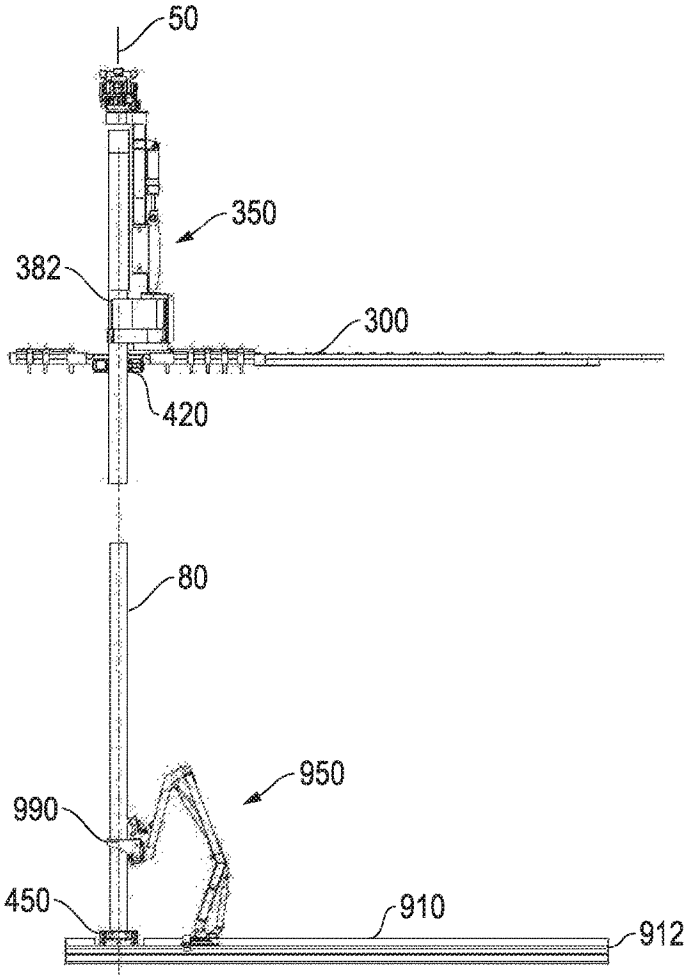
Figures 4, 22:
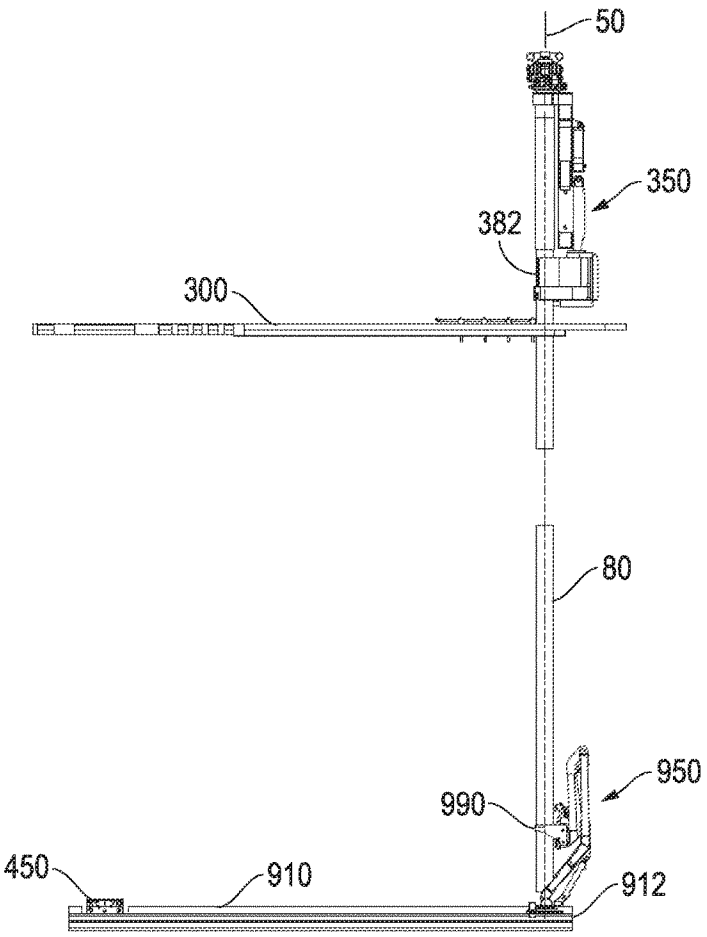
Figures 3, 22:
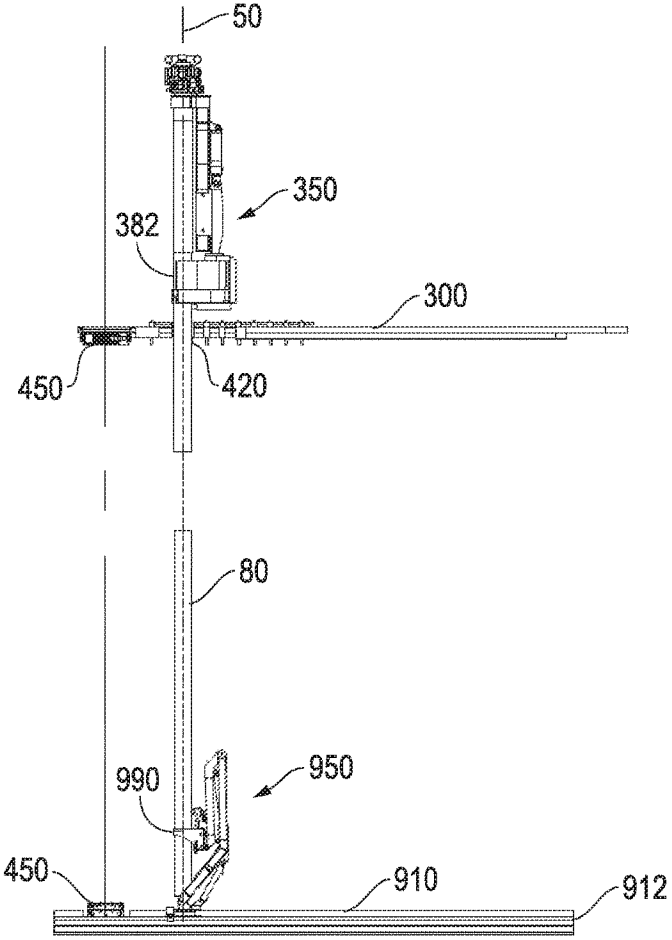
Figures 7, 22:
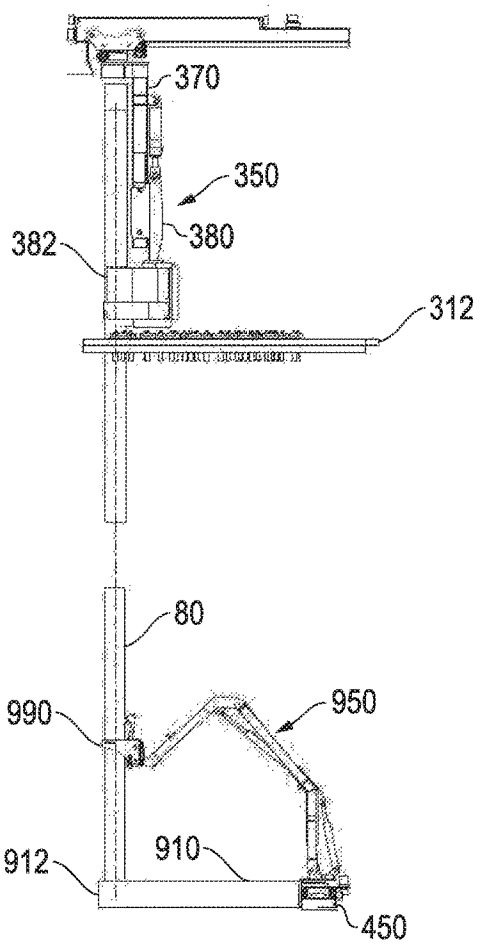
Figures 6, 22:
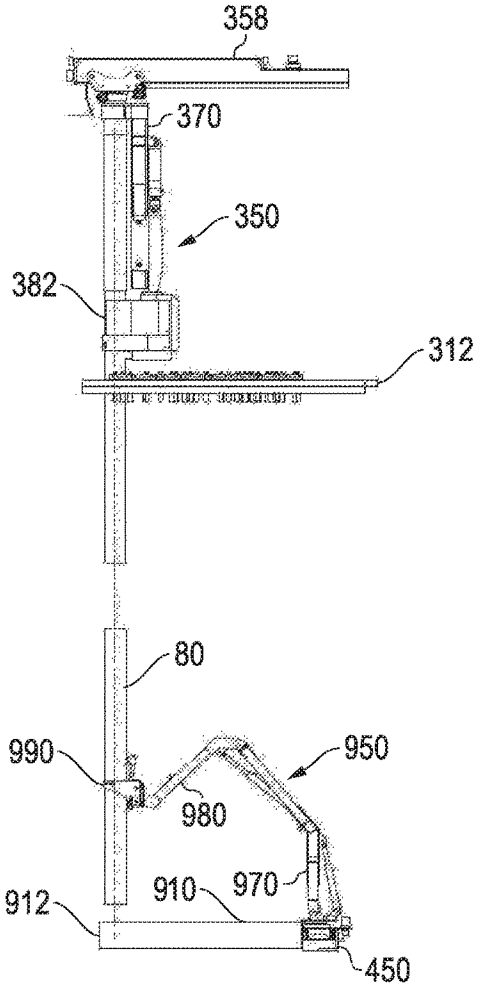
Figures 5, 22:
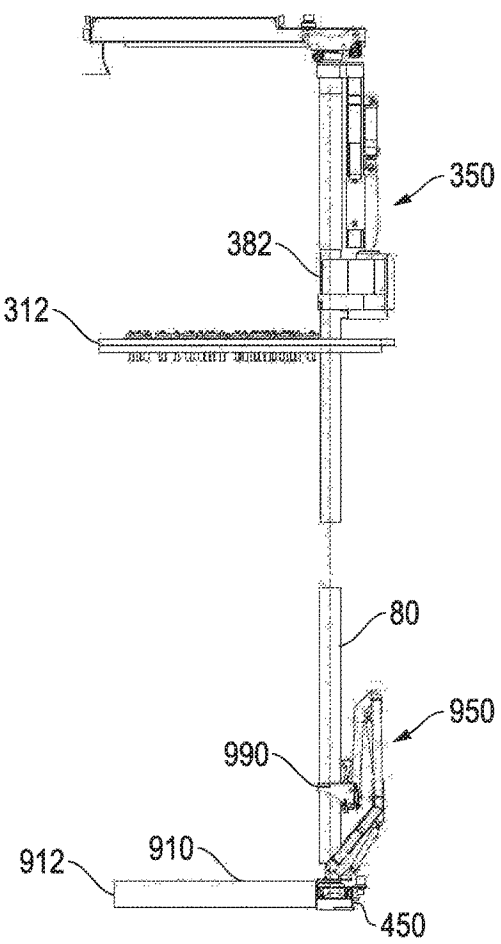

FIGS. 22-1 through 22-7 are side view schematics of the operation the automated tubular racking system, illustrating the cooperative workings of upper racking mechanism 350 (and 351), upper stand constraint 420, and lower racking mechanism 950.

FIG. 22-1 illustrates tubular stand 80 located at stand handoff position 50. The upper end of tubular stand 80 is secured by upper stand constraint 420. The lower end of tubular stand 80 is resting in stand hand-off station 450. Gripper 382 of upper racking mechanism 350 and clasp 990 of lower racking mechanism 950 are attaching to tubular stand 80.

FIG. 22-2 illustrates tubular stand 80 still located at stand handoff position 50. Tubular stand 80 has been secured by gripper 382 of upper racking mechanism 350 and clasp 990 of lower racking mechanism 950. Tubular stand 80 may be released by upper stand constraint 420 as it is hoisted upward by upper racking mechanism 350, and out of stand hand-off station 450.

FIG. 22-3 illustrates upper racking mechanism 350 and lower racking mechanism 950 transporting tubular stand 80 along alleyway 316 and alleyway 912, respectively. Lower racking mechanism 950 follows upper racking mechanism 350 in a master-slave relationship, always maintaining the verticality of tubular stand 80. To this end, lower racking mechanism 950 may rotate or extend arm 980 as necessary to accommodate unacceptable divergence in the paths of alleyway 316 in racking module 300 and alleyway 912.

FIG. 22-4 illustrates upper racking mechanism 350 and lower racking mechanism 950 stopped at a position on alleyway 316 and alleyway 912, respectively, that intersects the designated column 312 on fingerboard 310 for racking tubular stand 80.

FIG. 22-5 is viewed at 90 degrees rotation from FIG. 22-4. FIG. 22-5 illustrates the simultaneous rotation of upper racking mechanism 350 and lower racking mechanism 950 at the intersection of alleyways 316 and 912 with designated column 312 on fingerboard 310 for racking tubular stand 80.

FIG. 22-6 illustrates the simultaneous translation of arm 370 along bridge 358 of upper racking mechanism 350 (see FIG. 4) and extension of frame 970 and arm 980 of lower racking mechanism 950. In this manner, upper racking mechanism 350 and lower racking mechanism 950 simultaneously locate tubular stand 80 in the correct racking position in fingerboard 310 and on platform 910.

FIG. 22-7 illustrates tubular stand 80 landed on platform 910 of setback platform 900. Tubular stand 80 is landed by lowering sleeve 380 and gripper 382 on arm 370 of upper racking mechanism 350.

Figure 23:
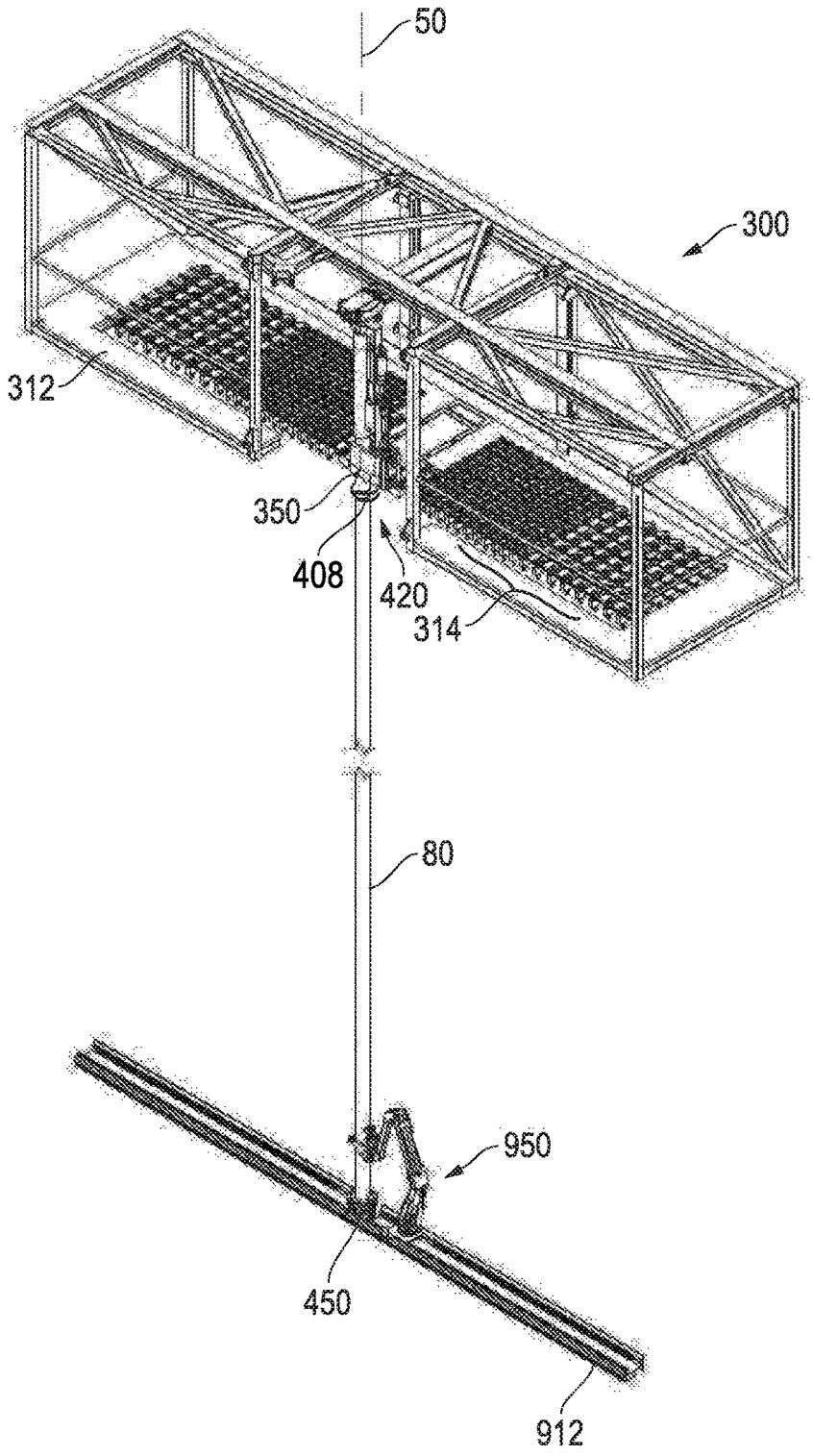
FIG. 23 is an isometric view of FIG. 21(6), illustrating a tubular stand supported vertically by the upper racking mechanism and held at its lower end by the lower racking mechanism, and extended to its designated racking position.

FIG. 23 is an isometric view of the FIG. 22-1, illustrating tubular stand 80 held at stand hand-off position 50 by upper stand constraint 420, and engaged by upper racking mechanism 350 and by lower racking mechanism 950. Optional engagement with lower stand constraint 440 is not shown.

Figure 24:
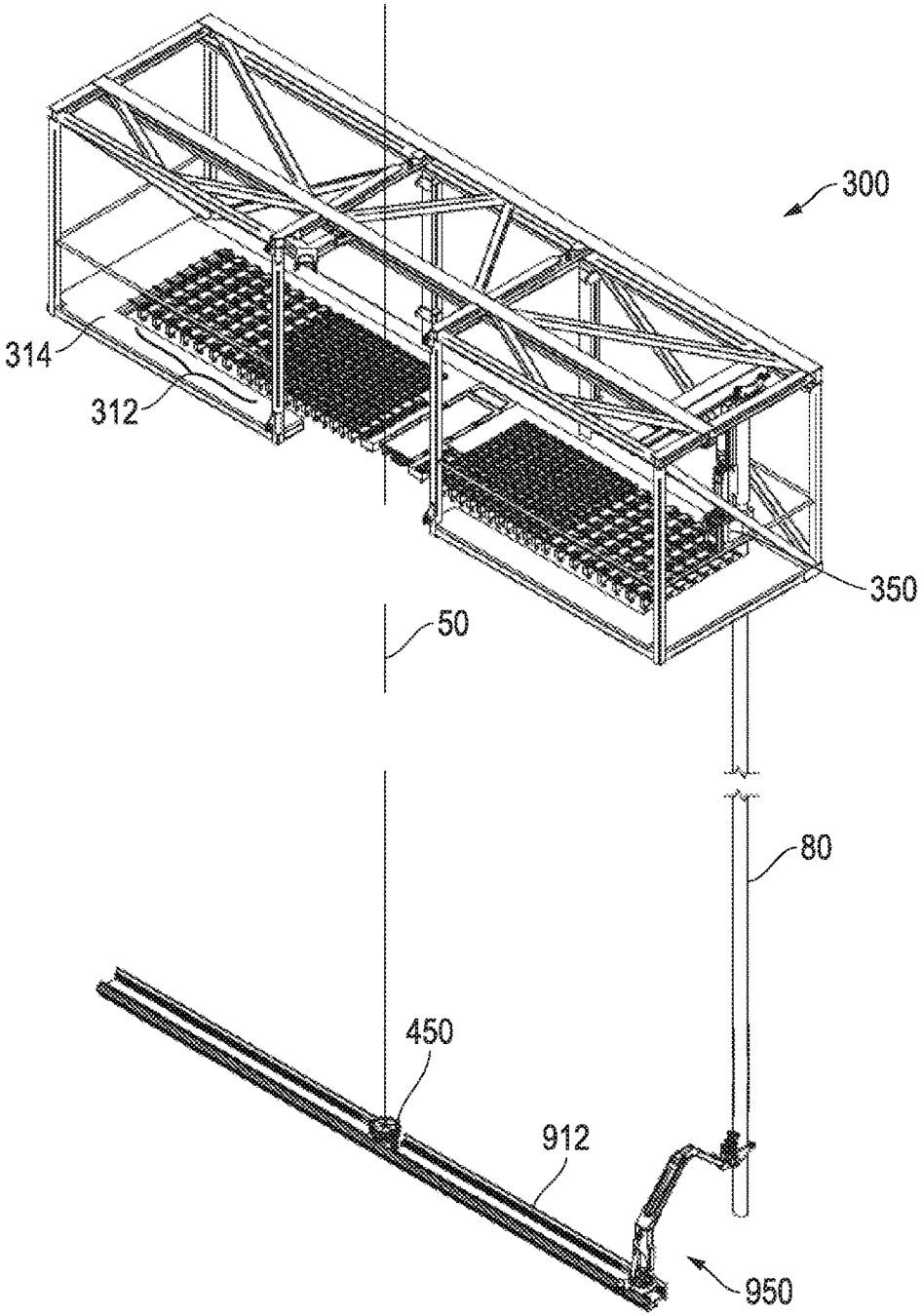
FIG. 24 is an operational sequence chart detailing an embodiment of the unique sequence of steps for tripping in, as may be performed by the automatic tubular racking system.

FIG. 24 is an isometric view of the FIG. 22-6, illustrating tubular stand 80 supported vertically by upper racking mechanism 350 and held at its lower end by lower racking mechanism 950, and extended to its designated racking position.

Figure 25:
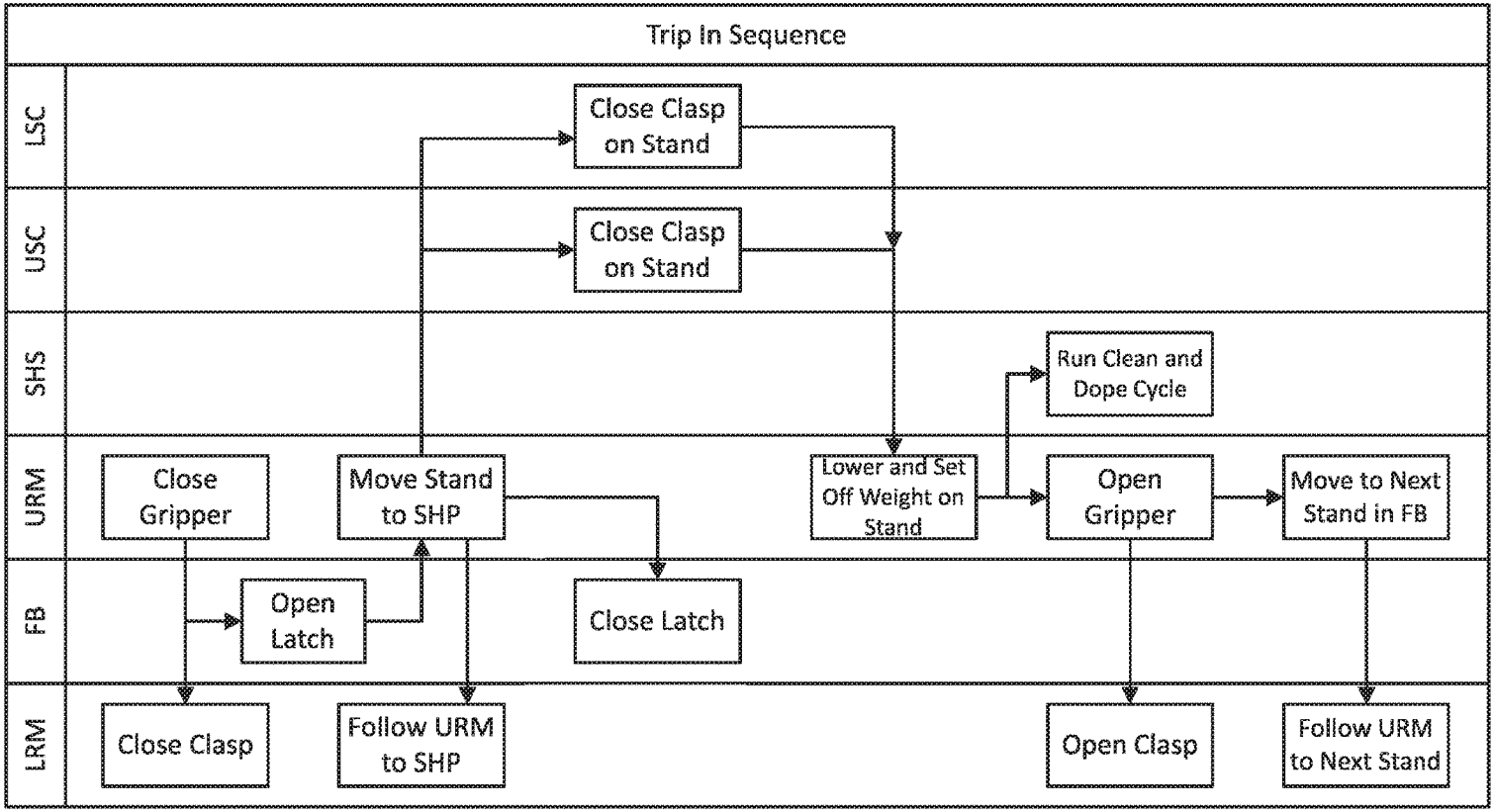
FIG. 25 is an operational sequence chart detailing an embodiment of the unique sequence of steps for tripping out, as may be performed by the automated tubular racking system.
Figure 26:
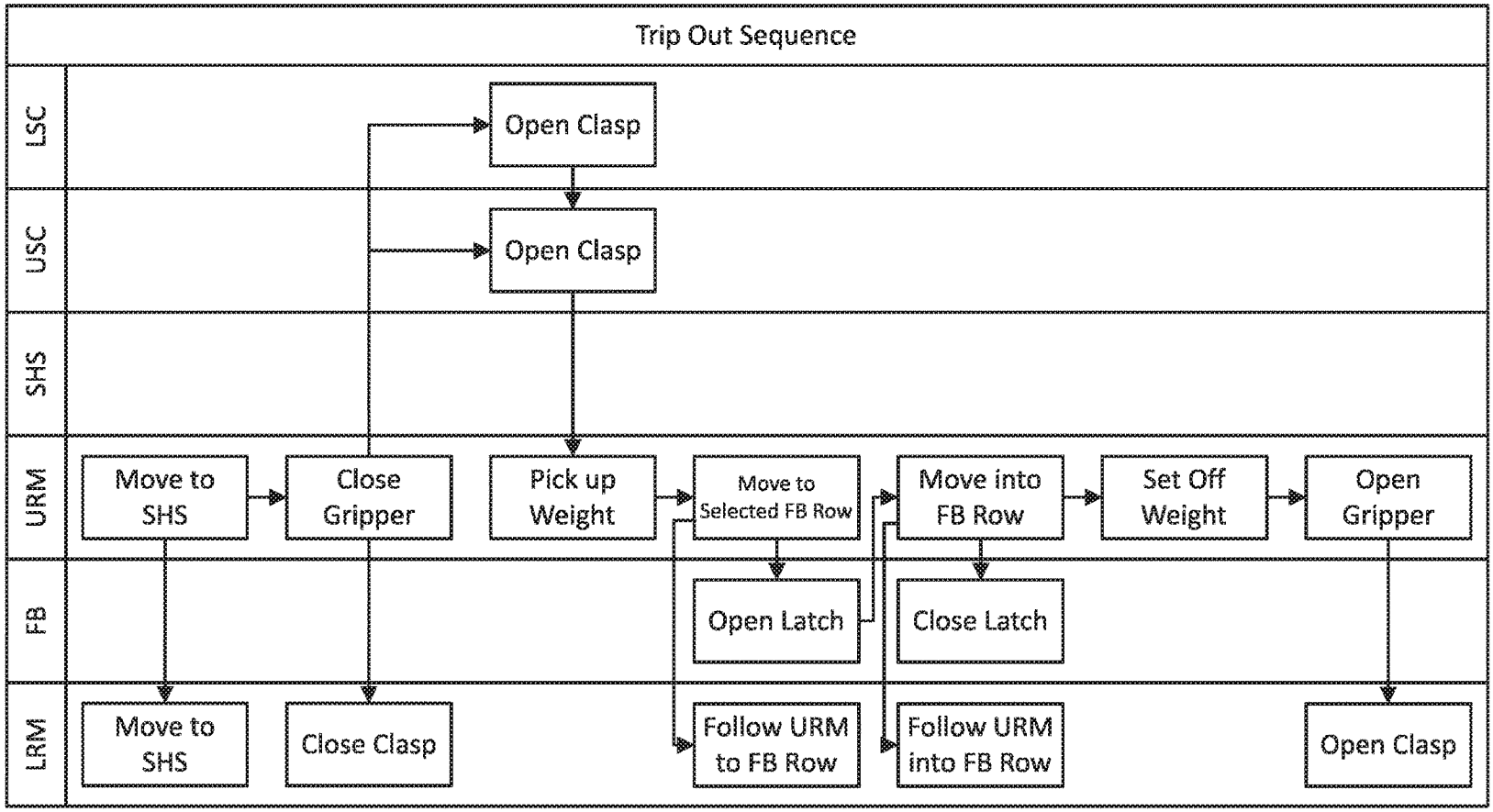

FIG. 25 is an operational sequence chart detailing an embodiment of the unique sequence of steps for tripping in, as used by the automated tubular racking system. FIG. 26 is an operational sequence chart detailing an embodiment of the unique sequence of steps for tripping out, as used by the automated tubular racking system. The following abbreviations are used in FIGS. 24 and 25:

LSC=Lower Stabilizing Arm
USC=Upper Stand Constraint
URM=Upper Racking Mechanism
FB=Finger Board
LRM=Lower Racking Mechanism
SHS=Stand Hand-off Station As seen in FIGS. 24 and 25, movement of lower racking mechanism 950 is controlled by instructions for movement or positioning of upper racking mechanism 350 in a programming logic relationship of master-slave.

Figure 27:
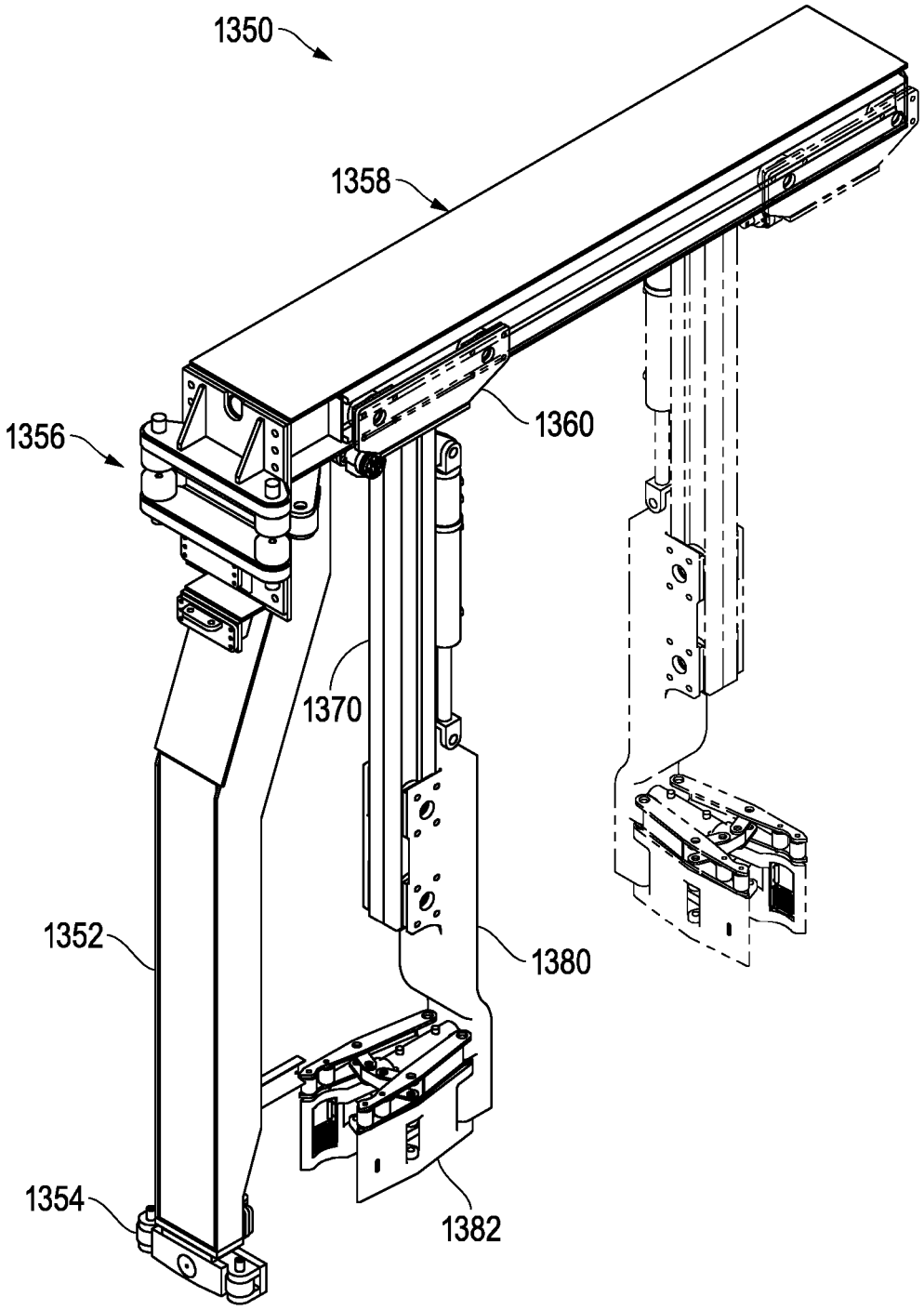
FIG. 27 is an isometric view of an alternative embodiment of the upper racking mechanism of illustrating rotation of the arm suspended from the boom.
Figure 28:
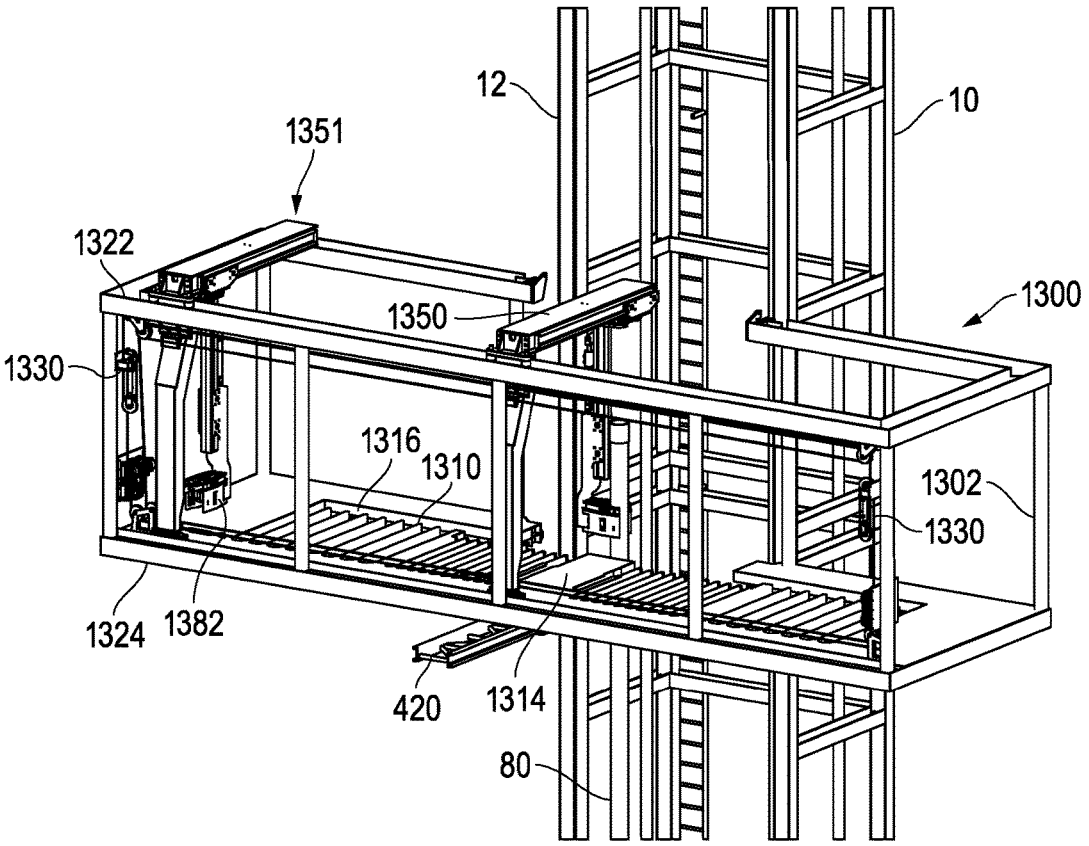
FIG. 28 is an isometric view of an alternative racking module, illustrating the alternative embodiment of the upper racking mechanism of FIG. 27 translating the alleyway and delivering a tubular stand to a stand hand-off position.

FIG. 27 is an isometric view of an alternative embodiment of an upper racking mechanism 1350 component of a racking module 1300 (see FIG. 28). In this embodiment, an upper racking mechanism 1350 includes a column 1352 that is translatably connected to racking module 1300 and has a boom 1358 attached and extending over racking module 1300. In the embodiment illustrated, a lower roller assembly 1354 is located at the base of column 1352. An upper roller assembly 1356 is located at the top of column 1352. Boom 1358 extends perpendicularly outward from the top of column 1352, in the direction of mast 10 of drilling rig 1.

A trolley 1360 is translatably mounted to boom 1358. The position of trolley 1360 may be controlled by a conventional motor and trolley controller. A rotate actuator 364 (such as seen in FIG. 4) is mounted to the bottom of trolley 1360.

Arm 1370 is connected to rotate actuator 364, and extends downward from trolley 1360. A sleeve 1380 mounted on arm 1370 is vertically translatable on arm 1370, such as by mounting of rollers or otherwise, as shown. A gripper 1382 is attached to sleeve 1380 for gripping tubular stands 80 racked in racking module 1300.

As illustrated in FIG. 4, a rotate actuator (or "arm rotation") centerline C extends downward from the center of rotation of rotate actuator 364. As previously described, this centerline is the same as the grip centerline C of tubulars 80 gripped by gripper 1382.

FIG. 28 is an isometric view of an alternative racking module 1300, illustrating upper racking mechanism 1350 traversing alleyway 1314 in the direction of the opening on front side 12 of mast 10, in preparation of reaching stand hand-off position 50.

Racking module 1300 has a fingerboard assembly 1310 comprising a plurality of finger extensions on each side of the fingerboard platform 1314. Tubular stand 80 is resting in fingerboard assembly 1310. Fingerboard platform 1314 is provided central to fingerboard assembly 1310 and in alignment with well bore 40 and mast 10. An alleyway 1316 is provided on fingerboard assembly 1310 for moving tubular stand 80 between a resting position in fingerboard assembly 1310 and stand hand-off position 50.

Racking module 1300 has a modular frame 1302 comprising an upper runway 1322 and a lower runway 1324. As seen in FIG. 27, upper roller assembly 1356 connects column 1352 of upper racking mechanism 1350 to upper runway 1322. Lower roller assembly 1354 connects column 1352 of transfer gantry crane 1350 to lower runway 1324. In this manner, transfer gantry crane 1350 may translate horizontally in the driller's side to off-driller's side directions across the full length of racking module 1300. A control cable assembly 1330 controls the translation of column 352 along module frame 320.

A second upper racking mechanism 1351 can be provided for mechanical redundancy, and optionally for coincident work. One option is to have gripper 1382 of transfer gantry crane 1351 different in tubular stand 80 gripping capability to that of gripper 1382 of transfer gantry crane 1350. Another option is to coordinate synchronous movement between upper racking mechanisms 1350 and 1351 for handling similar tubular stand 80 racked in separate locations of fingerboard assembly 1310.

If used herein, the term "substantially" is intended for construction as meaning "more so than not."

Having thus described the various embodiments, it is noted that the embodiments disclosed are illustrative rather than limiting in nature and that a wide range of variations, modifications, changes, and substitutions are contemplated in the foregoing disclosure and, in some instances, some features may be employed without a corresponding use of the other features. Many such variations and modifications may be considered desirable by a person skilled in the art based upon a review of the foregoing description of embodiments. Accordingly, it is appropriate that the appended claims be construed broadly and in a manner consistent with the scope of the disclosure.

The invention claimed is:

1. A tubular racking system, comprising:

a racking module connected to a drilling rig mast, wherein the racking module comprises a frame;

a fingerboard assembly connected to the frame, having columns receivable of tubular stands, the columns oriented in a direction towards the mast;

a fingerboard alleyway connecting the columns on a mast side of the columns;

an upper racking mechanism, wherein the upper racking mechanism comprises a bridge connected to the frame in translatable relation;

an arm connected to the bridge in rotatable and translatable relation;

a gripper connected to the arm in vertically translatable relation; and a second upper racking mechanism located in the racking module.

2. A tubular racking system, comprising:

a racking module connected to a drilling rig mast, wherein the racking module comprises a frame;

a fingerboard assembly connected to the frame, having columns receivable of tubular stands, the columns oriented in a direction towards the mast; and a fingerboard alleyway connecting the columns on a mast side of the columns;

an upper racking mechanism, wherein the upper racking mechanism comprises a bridge connected to the frame in translatable relation;

an arm connected to the bridge in rotatable and translatable relation; and a gripper connected to the arm in vertically translatable relation; and a setback platform module, wherein the setback platform module comprises a platform positioned beneath the fingerboard assembly;

a platform alleyway adjacent to the platform;

a lower racking mechanism comprising:

a base connected to the alleyway in translatable relation;

a frame connected to the base in rotatable and pivotal relation;

an arm pivotally connected to the frame; and a clasp pivotally connected to the arm; and a tubular centerline at the center of tubulars held by the gripper;

an arm rotation centerline at the center of rotation of the arm;

a clasp centerline at the center of rotation of the clasp when rotating the lower racking mechanism; and, the tubular centerline and the arm rotation centerline and the clasp centerline being coincident.

3. A tubular racking system, comprising:

a racking module connected to a drilling rig mast, wherein the racking module comprises a frame;

a fingerboard assembly connected to the frame, having columns receivable of tubular stands, the columns oriented in a direction towards the mast;

a fingerboard alleyway connecting the columns on a mast side of the columns;

an upper racking mechanism, wherein the upper racking mechanism comprises:

a bridge connected to the frame in translatable relation;

an arm connected to the bridge in rotatable and translatable relation a gripper connected to the arm in vertically translatable relation; and a lower stand constraint connected to a platform, wherein the lower stand constraint comprises a frame;

a carriage connected to the frame in extendable relationship;

a carriage actuator connected between the frame and the carriage, and operable to extend or retract the carriage outward from the frame;

a clasp attached to the extendable end of the carriage; and a clasp actuator connected to the clasp, and operable to open or close the clasp around a tubular stand, wherein the carriage extends towards a well center of the drilling rig to position a center of the clasp at the center of the stand hand-off position; and wherein the carriage retracts towards the platform to remove the clasp from vertical alignment with the alleyway.

4. A tubular racking system, comprising:

a racking module connected to a drilling rig mast, wherein the racking module comprises a frame;

a fingerboard assembly connected to the frame, having columns receivable of tubular stands, the columns oriented in a direction towards the mast;

a fingerboard alleyway connecting the columns on a mast side of the columns;

an upper racking mechanism, wherein the upper racking mechanism comprises:

a bridge connected to the frame in translatable relation;

an arm connected to the bridge in rotatable and translatable relation a gripper connected to the arm in vertically translatable relation; and a lower stand constraint connected to a platform, wherein the lower stand constraint comprises a frame;

a carriage connected to the frame in extendable relationship;

a carriage actuator connected between the frame and the carriage, and operable to extend or retract the carriage outward from the frame;

a clasp attached to the extendable end of the carriage; and a clasp actuator connected to the clasp, and operable to open or close the clasp around a tubular stand, wherein the carriage extends towards the well center to position a center of the clasp beyond the center of the stand hand-off position.

5. A tubular racking system, comprising:

a racking module connected to a drilling rig mast, wherein the racking module comprises a frame;

a fingerboard assembly connected to the frame, having columns receivable of tubular stands, the columns oriented in a direction towards the mast; and a fingerboard alleyway connecting the columns on a mast side of the columns;

an upper racking mechanism, wherein the upper racking mechanism comprises a bridge connected to the frame in translatable relation;

an arm connected to the bridge in rotatable and translatable relation; and a gripper connected to the arm in vertically translatable relation; and a setback platform module, wherein the setback platform module comprises a platform positioned beneath the fingerboard assembly;

a platform alleyway adjacent to the platform;

a lower racking mechanism comprising:

a base connected to the alleyway in translatable relation;

a frame connected to the base in rotatable and pivotal relation;

an arm pivotally connected to the frame; and a clasp pivotally connected to the arm; and a stand hand-off station comprising:

a base connected to the alleyway of the setback platform;

a chamber attached to the base; and, an elastomeric seal over a top end of the chamber, the seal having an opening receivable of a tubular stand received into the chamber.

6. The stand hand-off station of claim 5, further comprising:

a grease nozzle directed towards the interior of the chamber;

a grease supply line connected to the grease nozzle;

a wash nozzle directed towards the interior of the chamber;

a wash supply line connected to the wash nozzle; and, a drain for collection of wash residue.

7. A setback platform module (900) for a drilling rig comprising:

a platform (910) for vertical storage of tubular drilling stands (80);

the platform (910) having a mast side and an opposite catwalk side;

an alleyway (912) extending along the mast side of the platform (910);

the alleyway (912) being offset below the platform (910);

a stand hand-off position (50) located on the alleyway (912);

a geared rail (914) affixed to the alleyway (912);

a lower racking mechanism (950) comprising:

a base (952) translatably connected to the rail (914);

a frame (970) rotatably and pivotally connected to the base (952);

an arm (980) pivotally connected to the frame (970); and, a clasp (990) connected to the arm (980);

a pinion drive (956) on the base (952) engaged with the geared rail (914), operable to translate the lower racking mechanism (950) along the rail (914);

a rotate actuator (362) connected between the base (952) and the frame (970), operable to rotate the frame (970) in relation to the base (952);

a frame actuator (968) connected between the frame (970) and the base (952), operable to extend and retract the frame (970) in relation to the base (952);

an arm actuator (976) connected between the arm (980) and the frame (970), operable to extend and retract the arm (980) in relation to the frame (970); and, a clasp actuator (998) connected to the clasp (990) and operable to open and close the clasp (990) around a tubular stand (80).

* * * * *